US006095855A

United States Patent [19]

Iwata et al.

[11] Patent Number: 6,095,855

[45] Date of Patent: Aug. 1, 2000

[54] METHOD OF FITTING CONNECTORS AND THE CONNECTORS FOR USE IN THE METHOD

[75] Inventors: Yoshifumi Iwata; Hiroshi Watanabe; Takahiko Suzuki, all of Shizuoka, Japan

[73] Assignee: Yazaki Corporation, Tokyo, Japan

[21] Appl. No.: 09/113,341

[22] Filed: Jul. 10, 1998

[30] Foreign Application Priority Data

Jul. 10, 1997 [JP] Japan ..... 9-185589
Sep. 1, 1997 [JP] Japan ..... 9-236014

[51] Int. Cl.[7] ..... H01R 13/73

[52] U.S. Cl. ..... 439/553; 439/34

[58] Field of Search ..... 439/553, 569, 439/34, 552, 554, 557

[56] References Cited

U.S. PATENT DOCUMENTS

| | | | |
|---|---|---|---|
| 3,569,909 | 3/1971 | Garver | 439/557 |
| 3,989,343 | 11/1976 | Lucius et al. | 439/557 |
| 4,883,432 | 11/1989 | Reed | 439/553 |
| 5,046,956 | 9/1991 | Takano | 439/553 |
| 5,173,061 | 12/1992 | Comerci et al. | 439/553 |
| 5,733,146 | 3/1998 | Block | 439/553 |

FOREIGN PATENT DOCUMENTS

| | | | |
|---|---|---|---|
| 5-91628 | 4/1993 | Japan | H02G 3/28 |
| 7-106033 | 4/1995 | Japan | H01R 31/06 |
| 8-330019 | 12/1996 | Japan | H01R 13/52 |
| 9-45433 | 2/1997 | Japan | H01R 13/74 |

*Primary Examiner*—Paula Bradley
*Assistant Examiner*—Katrina Davis
*Attorney, Agent, or Firm*—Sughrue, Mion, Zinn, Macpeak & Seas, PLLC

[57] ABSTRACT

A method of fitting connectors includes a step of inserting a first connector into a mounting hole of a joint body from one side of the mounting hole in order to temporarily retain the first connector in the mounting hole, a step of inserting a second connector into the mounting hole from the other side of the joint body in order to release the condition in that the first connector has been retained in the mounting hole simultaneously with fitting both connectors to each other, and a step of inserting the second connector into the mounting hole further so that the second connector is primarily fixed in the mounting hole.

9 Claims, 19 Drawing Sheets

75
81
83
65
73
71
61
67
79

133
125
127
63
61
121
139
137
143

151
125
127
63
61
121
139
157
159a
155

251
255
255a
254a
254
270
125
127
131
63
61
239
121

351
353
355
355a
338
328
328a
327
325
329
329a
321
63
61

METHOD OF FITTING CONNECTORS AND THE CONNECTORS FOR USE IN THE METHOD

BACKGROUND OF THE INVENTION

1. Field of the Invention

This invention relates to a method of fitting connectors and the connectors for use in the method, for easily ascertaining whether the connectors have been completely or incompletely fitted to each other. The present application is based on Japanese Patent Application Nos. Hei. 9-185589 and Hei. 9-236014 which are incorporated herein by reference.

2. Description of the Related Art

A so-called mount-on-panel type connector is such that a mating connector is fitted into the other connector retained in a through-hole of a vehicle body. A connector of the sort disclosed in, for example, Unexamined Japanese Patent Publication No. Hei. 5-91628 will be described with reference to FIGS. 18, 19 and 20. FIG. 18 is an exploded perspective view of a door illustrative of a wiring method; FIG. 19, an exploded perspective view of a connector supporting structure on a trim side; and FIG. 20, an exploded perspective view of a connector supporting structure on a frame side. A connector 5 on a trim side is provided in one end portion of a harness 3 on the trim side, the harness 3 being wired to the side of a door trim 1. A pair of U-shaped connector supports 7 projecting toward a door frame 9 are provided on the lower side of the intermediate portion of the door trim 1 in such a manner that the open sides of the connector supports 7 face each other. A rubber ring 11 is mounted on the connector 5 on the trim side. The connector 5 on the trim side is press-fitted in between the pair of connector supports 7 in such a state that projections 13 projecting from the outer surface of the connector 5 are retained in engaging holes 15 bored in the rubber ring 11 in a manner free from slipping off. The connector 5 on the trim side is so postured that it is allowed to slightly move vertically and horizontally and held within a plane perpendicularly intersecting the direction of the door frame 9 because of the elastic deformation of the rubber ring 11.

On the other hand, a connector-supporting recessed portion 17 is provided on the side of the door frame 9 facing the connector 5 on the trim side. Further, a connector 21 on the frame side is provided in an end portion branching off the mid-portion of a harness 19 on the frame side wired to the side of the door frame 9. The connector 21 on the frame side is fitted into the connector-supporting recessed portion 17 and mounted therein in such a state that flexible retaining protrusions 23 provided on the outer side surfaces of the connector 21 on the frame side have been retained in retaining holes 25 provided in the inner peripheral surface of the connector-supporting recessed portion 17, respectively. The connector 21 on the frame side in this case is so postured and held that it is allowed to slightly move in one direction because of the flexibility of the retaining protrusions 23.

When the door trim 1 with the harness 3 thus wired is incorporated into the door frame 9 with the harness 19 on the frame side thus wired as shown in FIG. 18, the connector 5 on the trim side is automatically connected to the connector 21 on the frame side. The slight shifting of both connectors 5, 21 from each other at this time is absorbed by the freedom of the rubber ring 11 and the retaining protrusions 23, whereby both connectors are precisely connected to each other.

The aforesaid method is effective when there exists the necessity of connecting circuits for electric equipment on the side of the door frame 9 and what is on the side of the door trim 1 and besides these circuits become readily connectable.

In addition, a rubber grommet is mounted on a panel as a mount-on-panel type connector of the sort described above and this grommet is brought into intimate contact with the panel so that it has a waterproof sealing function as disclosed in Unexamined Japanese Patent Publication No. Hei. 8-330019. This connector will subsequently be described with reference to FIG. 21, which is an exploded perspective view of a conventional waterproof connector.

A waterproof connector 31 in this example comprises an inside connector 37 mounted from the inside with respect to a panel 35 which has a mounting hole 33 and used to partition the environment into the inside and the outside, and an outside connector 39 mounted from the outside. The outside connector 39 comprises a connector housing 41 for accommodating terminal metal fittings (not shown) pressure-welded to the tip of an electric wire, a panel sealing grommet 43 for covering one side of the connector housing 41 from which the electric wire is drawn, tying up the electric wire thus drawn in a bundle and guiding the bundle to one side, and a grommet cover 45 for covering the grommet 43 and press-holding the peripheral edge of the grommet 43 toward the panel 35. The inside and outside connectors 37, 39 are coupled to each other by tightly screwing a bolt 47 passed through from the side of the aforesaid grommet cover 45 into the inside connector 37.

In the case of the waterproof connector 31 thus constructed, the grommet 43 is put on the connector housing 41 while retaining projections 51, 53 of covers 41*b*, 41*c* for covering a base body 41*a* are being inserted into the through-hole 49 of the grommet 43, and the leading end sides of the respective retaining projections 51, 53 are projected out of the through-hole 49. Subsequently, the grommet cover 45 is put on the grommet 43. While the grommet cover 45 is being slid along the surface without the retaining projections 51, 53 and moved to a proper fit-in position with respect to the grommet 43, the mounting of the grommet 43 is completed in a state in which the grommet 43 is kept in intimate contact with the panel 35.

In the conventional connector shown in FIGS. 18, 19 and 20, however, since it has been arranged that the connector 5 on the trim side and the connector 21 on the frame side are indirectly positioned and fitted to each other by incorporating the door trim 1 into the door frame 9, the problem is that the (incompletely and completely) fitted condition of both connectors 5, 21 remains hardly easily confirmable.

In the conventional connector shown in FIG. 21, since the fit-in portions of the inside and outside connectors 37, 39 are hidden by the grommet 43, the fit-in work becomes difficult to do. Further, since the base body 41*a* and the pair of covers 41*b*, 41*c* for covering the rear surface side of the base body 41*a* are used for forming the outside connector 39 and since the grommet cover 45 for press-fitting and holding the grommet 43 is required, the problem is that the number of parts tends to increase and this results in lowering fitting workability.

SUMMARY OF THE INVENTION

With the foregoing in view, it is an object of the present invention to provide a method of fitting connectors by which their fitted condition is made readily confirmable, and connectors for use in this method; and another object of the present invention is to provide a method of fitting connectors by which confirmation of their fitted condition, fitting work and waterproof treatment are readily made and connectors for use in this method.

In order to accomplish the above objects, according to the first aspect of the present invention, there is provided a method of fitting connectors comprising the steps of:

providing a first connector, a second connector fittable into the first connector and a joint body having a mounting hole;

inserting the first connector into the mounting hole from one side face of the joint body;

temporarily retaining the first connector in the mounting hole;

inserting the second connector into the first connector from the other side face of the joint body;

releasing the temporary retaining condition of the first connector in the mounting hole simultaneously with fitting the first and second connectors to each other; and inserting the second connector into the mounting hole so that the second connector is primarily retained in the mounting hole.

According to the second aspect of the present invention, in the method of fitting connectors of the first aspect, the joint body has a connector fixing arm formed adjacent to the mounting hole, wherein, in the step of temporarily retaining, the first connector is retained in the mounting hole by the connector fixing arm, and the method further comprises the step of:

subjecting the connector fixing arm to elastic deformation by an inserting force of the second connector so that the first connector is released from being temporarily retained in the mounting hole.

According to the third aspect of the present invention, in the method of fitting connectors of the first aspect, the first connector has a temporarily fixing piece which can be folded, wherein, in the step of temporarily retaining, the first connector is retained in the mounting hole with the temporarily fixing piece, and the method further comprises the step of:

folding the temporarily fixing piece by an inserting force of the second connector so that the first connector is released from being temporarily retained in the mounting hole.

According to the fourth aspect of the present invention, in the method of fitting connectors of the first aspect, the first connector includes an elastic arm having a semi-locking projection, wherein, in the step of temporarily retaining, the first connector is retained in the mounting hole with the semi-locking projection of the elastic arm, and the method further comprises the steps of:

pressing the semi-locking projection to the mounting hole by forcing the elastic arm to expand in accordance with an inserting force of the second connector; and removing the semi-locking projection from the mounting hole by the inserting force of the second connector so that the first connector is released from being temporarily retained in the mounting hole.

According to the fifth aspect of the present invention, in the method of fitting connectors of the fourth aspect, the step of providing comprising a step of providing a grommet fitted to an outer periphery of the second connector, and the method further comprises the step of:

fitting the grommet into the mounting hole so as to fix the second connector in the joint body after the step of removing.

According to the sixth aspect of the present invention, there is provided a connector which comprises:

a first connector;

a joint body including a mounting hole into which the first connector is insertable;

a temporarily retaining mechanism with which the first connector is temporarily retained in the mounting hole when the first connector is inserted into the mounting hole;

a second connector fittable into the first connector, and adaptable to release the first connector from being temporarily retained in the mounting hole by an inserting force deriving from fitting of the first and second connectors when the second connector is fitted into the first connector; and a primarily retaining mechanism with which the second connector is primarily retained in the mounting hole.

According to the seventh aspect of the present invention, in the connector of the sixth aspect of the present invention, the temporarily retaining mechanism comprises:

a connector fixing arm projecting toward a center of the mounting hole, the connector fixing arm being formed in an edge portion of the mounting hole; and an engaging hole formed in the first connector, the engaging hole being releasably engaged with the connector fixing arm;

the primarily retaining mechanism comprises:

a connector fixing hole formed in the second connector, the connector fixing hole being engaged with the connector fixing arm.

According to the eighth aspect of the present invention, in the connector of the sixth aspect of the present invention, the temporarily retaining mechanism comprises:

a first protrusion protruding from an outer surface of the first connector; and a temporarily fixing piece provided on the outer surface of the first connector, the temporarily fixing piece having a flexibility and clamping an edge portion of the mounting hole in cooperation with the first protrusion;

the primarily retaining mechanism comprises:

a second protrusion protruding from an outer surface of the second connector; and a primarily fixing piece provided on the outer surface of the second connector, the primarily fixing piece having a flexibility and clamping the edge portion of the mounting hole in cooperation with the second protrusion.

According to the ninth aspect of the present invention, the connector of the sixth aspect of the present invention, the temporarily retaining mechanism comprises:

an elastic arm protruding from an outer surface of the first connector;

a semi-locking projection formed on an outer surface of the elastic arm; and an auxiliary arm protruding from the outer surface of the first connector, the auxiliary arm having a flexibility and clamping an edge portion of the mounting hole in cooperation with the semi-locking projection;

the primarily retaining mechanism comprises:

a protrusion protruding from an outer surface of the second connector; and a primarily fixing piece provided on the outer surface of the second connector, the primarily fixing piece having a flexibility and clamping the edge portion of the mounting hole in cooperation with the protrusion.

According to the tenth aspect of the present invention, in the connector of the ninth aspect of the present invention, the primarily retaining mechanism includes a grommet fitted on an outer periphery of the second connector, the grommet having a peripheral groove formed in an outer periphery thereof, the peripheral groove engaged with the mounting hole.

According to the eleventh aspect of the present invention, in the connector of the sixth aspect of the present invention, the temporarily retaining mechanism comprises:

elastic arms protruding from an outer surface of the first connector; and a pair of semi-locking projections capable of respectively engaging with front and rear edge sides of the mounting hole, the semi-locking projections being respectively formed in outer surfaces of the elastic arms.

According to the twelfth aspect of the present invention, in the connector of the eleventh aspect of the present invention, the elastic arms are provided on the respective outer surfaces of the first connector facing edge portions of the mounting hole.

According to the thirteenth aspect of the present invention, in the connector of the twelfth aspect of the present invention, the primarily retaining mechanism comprises:

at least a pair of elastic retaining pieces formed on an outer periphery of a body of the second connector, tips of the elastic retaining pieces extending in a rear direction of the second connector, the elastic retaining pieces being equipped with retaining projections capable of engaging with one side of an edge portion of the mounting hole; and a grommet fitted to a back end of the outer periphery of the body, the grommet being equipped with an engaging portion capable of engaging with the other side of the edge portion of the mounting hole, wherein the retaining projections and the engaging portion clamp the edge portion of the mounting hole.

In the method of fitting connectors, the first connector drops from the joint body simultaneously when the first connector and the second connector are fitted to each other and it can be utilized to confirm the fitted condition of both connectors whether or not the first connector has thus dropped therefrom.

Moreover, the feeling of clicking produced then makes it surer to confirm the fitted condition of both connectors. In addition, the temporarily retaining strength of the first connector is increased before the first connector is fitted in by expanding the elastic arms and pressing the semi-locking projections into the mounting hole when the second connector is inserted.

When the grommet is mounted on the outer periphery of the second connector, further, a series of operations in the direction in which the second connector is inserted results in fixing the second connector in the joint body via the grommet in a waterproof fashion, so that the fitting work and waterproof treatment are facilitated.

In the connector according to the present invention, the first connector is temporarily retained by the temporarily retaining mechanism which is made releasable by the inserting force of the second connector and after the second connector is completely fitted into the first connector in the temporarily retained condition, the second connector is further inserted, whereby the temporarily retained condition of the first connector is released and the second connector is subsequently and primarily retained in the joint body.

Then the first connector is provided with the engaging hole and the second connector is provided with the connector fixing hole and further the connector fixing arms engaging with both holes are provided for the mounting hole; thus, the first connector in the temporarily retained condition is held by the joint body; the first connector is dropped in the fitted condition; further, the second connector is fixed in the joint body.

Further, the temporarily retained strength is increased when both connectors are fitted to each other by providing a structure in which the temporarily fixing pieces are provided for the first connector and the temporarily fixing pieces expanded in an inverted V shape is retained in the joint body.

Further, the semi-locking projections are provided for the elastic arms and removed from the mounting hole by subjecting the elastic arms to elastic deformation by the inserting force of the second connector, so that a feeling of clicking is produced when the first connector and the second connector are fitted to each other.

Further, the grommet provided for the second connector is used as the primarily retaining mechanism for fixing the second connector in the joint body so as to seal up the gap between the mounting hole and the connector in the waterproof fashion without using a waterproof member for the first connector.

In the connector according to the present invention, the temporarily retaining mechanism comprises the elastic arms protruding from the outer surface of the first connector, and the pair of semi-locking projections capable of respectively engaging with the front and rear edge sides of the mounting hole formed in the outer surface of each elastic arm to ensure that the temporarily retained condition is firmly locked.

The first connector is so structured that the elastic arms are provided on the whole outer surface facing the edge portion of the mounting hole to ensure that the temporarily retained condition is firmly locked and that centering is attainable.

In the connector according to the present invention, the primarily retaining mechanism comprises at least the pair of elastic retaining pieces formed on the outer periphery of the body of the second connector, the tips of the elastic retaining pieces extending in the rear direction of the second connector, the elastic retaining pieces being equipped with the retaining projections capable of engaging with one side of the edge portion of the mounting hole, and the grommet which is fitted to the rear end of the outer periphery of the body thereof and equipped with the engaging portion capable of engaging with the other side of the edge portion of the mounting hole, the retaining projections and the engaging portion being used for clamping the edge portion of the mounting hole, whereby the gap between the mounting hole and the connector is sealed up in the waterproof fashion without using the waterproof member for the first connector and moreover the primarily retaining mechanism becomes easily releasable without bending the elastic retaining pieces.

According to the fourteenth aspect of the present invention, in the connector of the sixth aspect of the present invention, the temporarily retaining mechanism comprises:

elastic arms protruding from an outer surface of the first connector, and having a flexibility; and wings coupled to side surfaces of the elastic arms, the wings being extended to make the first connector retainable in the mounting hole, and the wings having inducing tilted surfaces which extend toward positions further than leading ends of the elastic arms, the second connector includes a wing accommodating portion into which the wings are insertable while being bent, wherein the wings are inserted into the wing accommodating portion while being bent before the first connector and the second connector are completely fitted to each-other.

With the arrangement described above, since each wing demonstrates the function of guiding the operation of inserting the second connector when the second connector is inserted, the insertion of the second connector in an inclined direction is preventable to ensure that both members are fitted and retained to each other.

DETAILED DESCRIPTION OF THE PREFERRED EMBODIMENTS

A detailed description will subsequently be given of a method of fitting connectors and connectors for use in the method with reference to FIGS. 1 through 17.

First Embodiment

Figure 1:
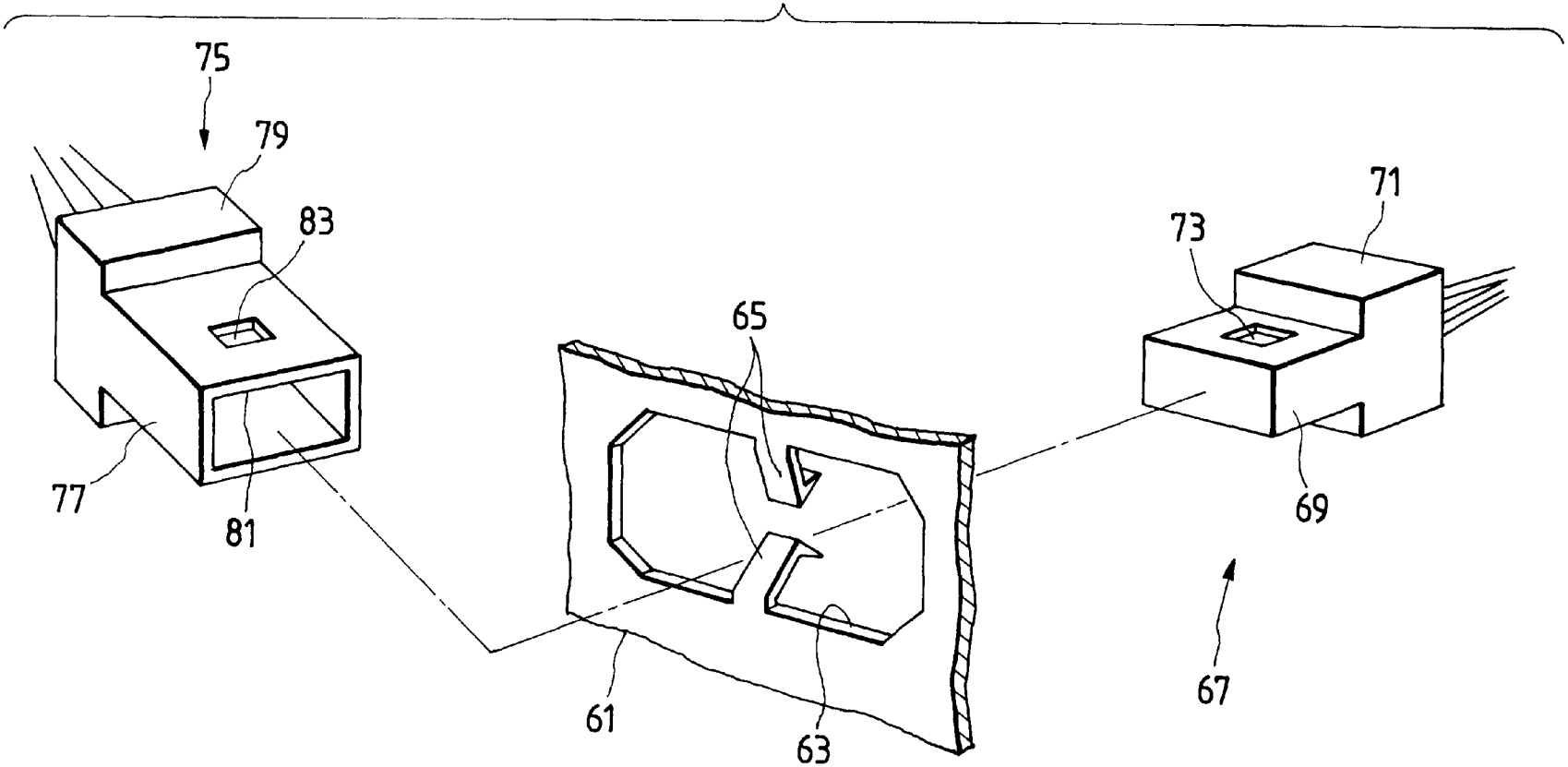
FIG. 1 is an exploded perspective view of a first embodiment of the present invention.
Figures 2A, 2B, 2C:
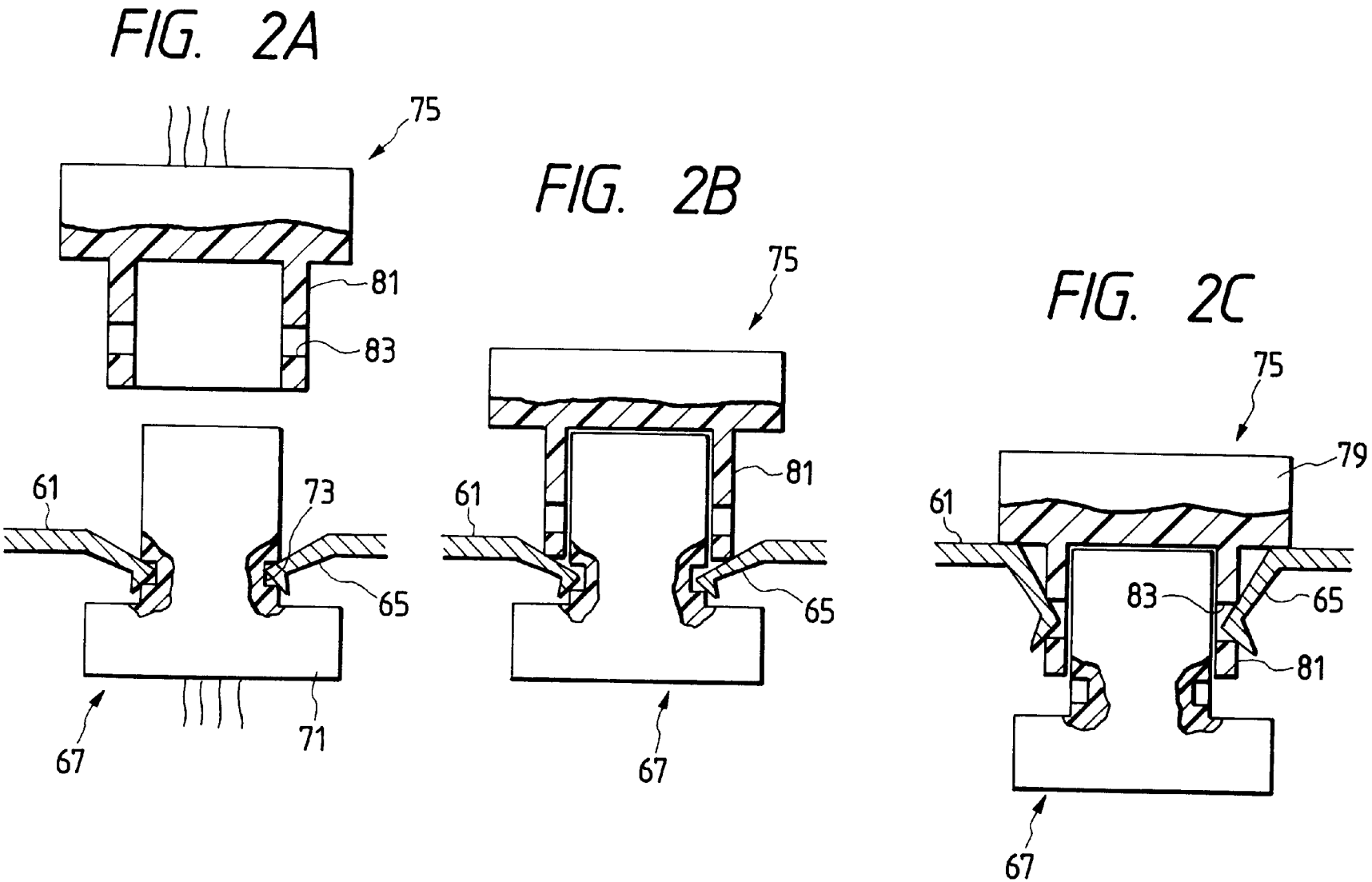
FIGS. 2A, 2B and 2C are diagrams illustrating a procedure for fitting connectors to each other according to the first embodiment of the present invention.

FIG. 1 is an exploded perspective view of a first embodiment of the present invention; and FIGS. 2A, 2B and 2C, diagrams illustrating a procedure for fitting connectors to each other according to the first embodiment of the present invention.

A rectangular mounting hole 63 is bored in a joint body 61 of a vehicle panel or the like. A pair of connector fixing arms 65 serving as temporarily and primarily retaining mechanism are each projected from the parallel two sides of the mounting hole 63 toward the center of the hole. The connector fixing arms 65 are flexible, each having the leading end bent into a V-shape, and can be subjected to elastic deformation with respect to the two sides of the joint body 61.

A protrusion 71 is protruded from the upper and lower rear surfaces of the housing 69 of a first connector 67 of a female connector which is mounted with a female terminal, for example. Further, engaging holes 73 serving as a temporarily retaining mechanism, with which the connector fixing arms 65 engage are provided in the upper and lower front surfaces of the housing 69. Consequently, the first connector 67 is temporarily retained in the mounting hole 63 via the connector fixing arms 65 by inserting the leading end side of the housing 69 into the mounting hole 63 because the elastically deformed connector fixing arms 65 engage with the respective engaging holes 73.

A protrusion 79 is protruded from the upper and lower rear surfaces of the housing 77 of a second connector 75 as a male connector which is mounted with a male terminal, for example. The leading end of the housing 77 of the second connector 75 is formed into a hood portion 81 for accommodating the leading end of the first connector 67. The outer shape of the hood portion 81 is formed smaller than the mounting hole 63. Connector fixing holes 83 serving as a primarily retaining mechanism are formed in the upper and lower surfaces of the hood portion 81, so that the connector fixing holes 83 engage with the respective connector fixing arms 65.

A description will subsequently be given of a method of fitting connectors according to this embodiment of the present invention.

As shown in FIG. 2, the leading end of the housing 69 of the first connector 67 is inserted into the joint body 61 to hold the first connector 67 in the joint body 61 in the temporarily retained condition by engaging the connector fixing arms 65 with the respective engaging holes 73. The first connector 67 causes the connector fixing arms 65 to engage with the respective engaging holes 73 and prevents itself from dropping from the joint body 61 as the protrusion is brought into contact with the connector fixing arms 65.

Subsequently, the second connector 75 is inserted from a side opposite to the side from which the first connector 67 has been inserted in order to insert the leading end of the first connector 67 into the hood portion 81 of the second connector 75. At this time, the first connector 67 maintains the condition in which it is held by the connector fixing arms 65 and when the second connector 75 is primarily inserted, the first connector 67 and the second connector 75 are completely fitted to each other.

When the second connector 75 is press-fitted in the inserting direction in that state, the leading end of the hood portion 81 of the second connector 75 is brought into contact with the connector fixing arms 65, which is then deformed, whereby the connector fixing arms 65 is released from engaging with the first connector 67.

Further, the first connector 67 is made to drop from the joint body 61 by press-fitting the second connector 75. Then the connector fixing arms 65 engage with the connector fixing holes 83 provided in the outer periphery of the hood portion 81 of the second connector 75, and the second connector 75 is fixed in the joint body 61. Since the first connector 67 dropped from the joint body 61 is kept fitting in the second connector 75, it remains indirectly fixed in the joint body 61 via the second connector 75. The connector fixing arms 65 engage with the connector fixing holes 83 of the second connector 75, and the protrusion 70 in the rear of the housing 77 is brought into contact with the connector fixing arms 65 to ensure that it is fixed in the joint body 61.

In this method of fitting connectors, it is facilitated to confirm the fitted condition of both connectors since the first connector 67 drops from the joint body 61 simultaneously when the first connector 67 is fitted into the second connector 75.

In this connector, the provision of the engaging holes 73 in the first connector 67, that of the connector fixing holes 83 in the second connector 75 and that of the connector fixing arms 65 engaging with both holes 73, 83 in the mounting hole 63 make it possible holding the first connector 67 in the joint body 61 in the temporarily retained condition, causing the first connector 67 to drop from the joint body 61 and further fixing the second connector 75 in the joint body 61.

Second Embodiment

Figure 3:
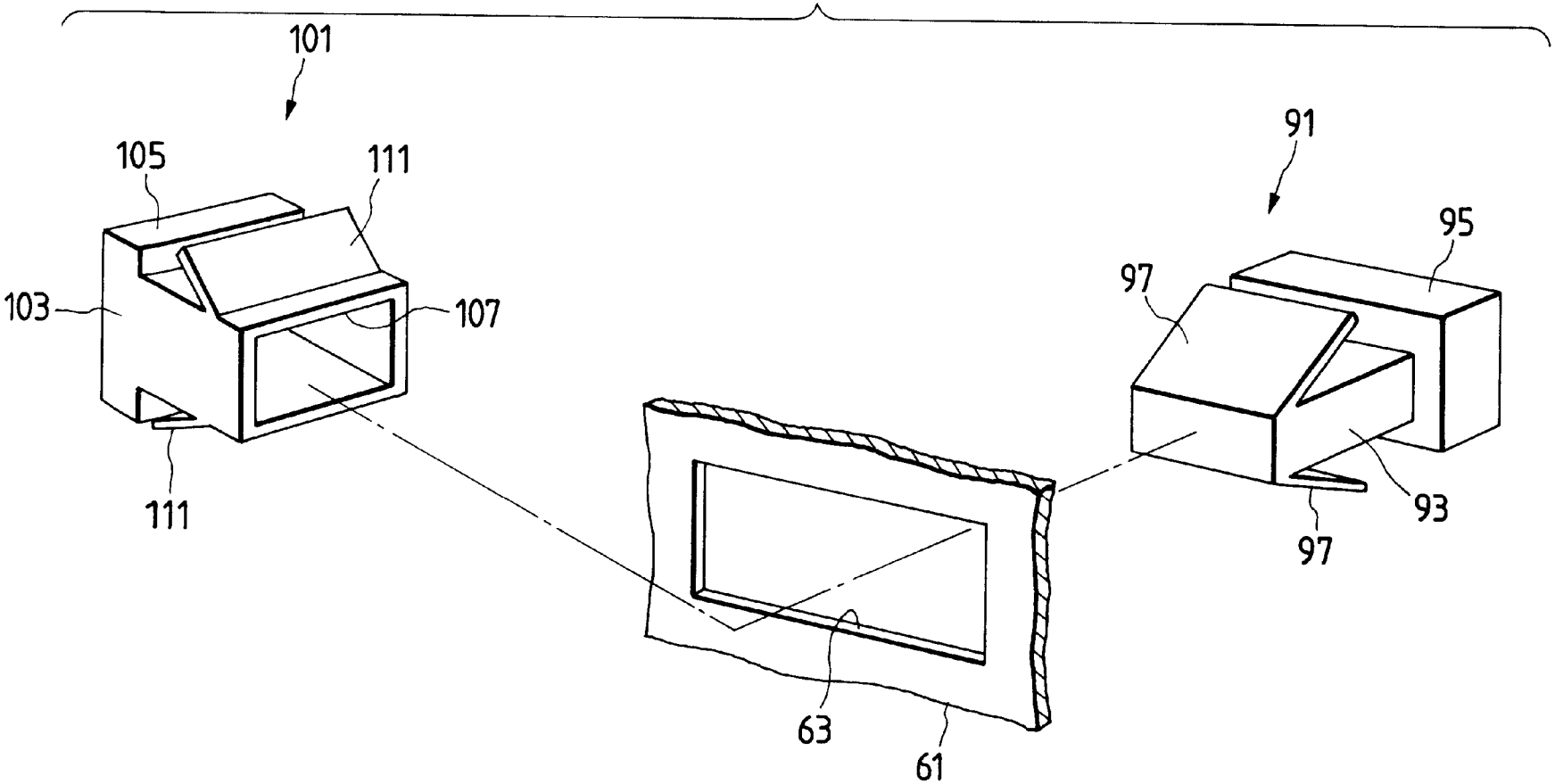
FIG. 3 is an exploded perspective view of a second embodiment of the present invention.
Figure 4A:
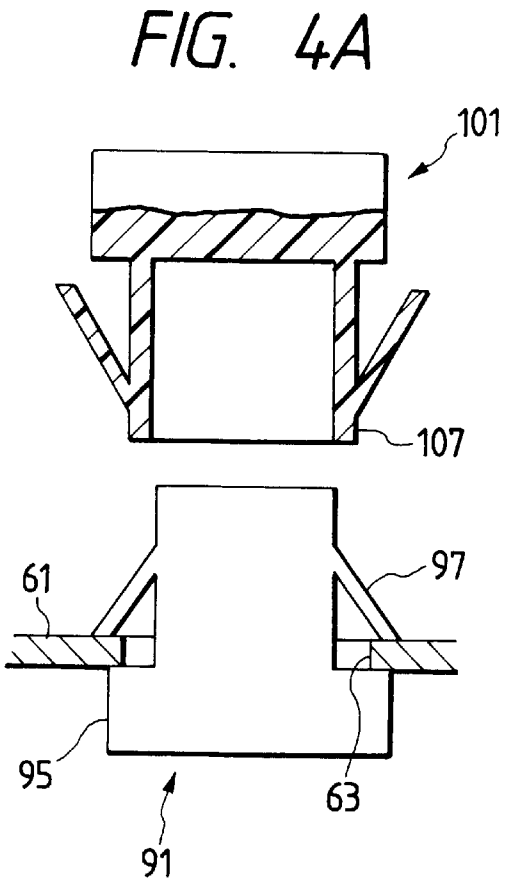
FIGS. 4A, 4B and 4C are diagrams illustrating a procedure for fitting connectors to each other according to the second embodiment of the present invention.
Figure 4B:
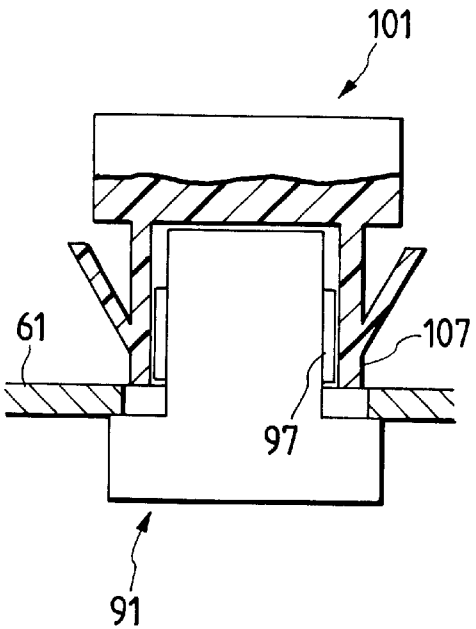
Figure 4C:
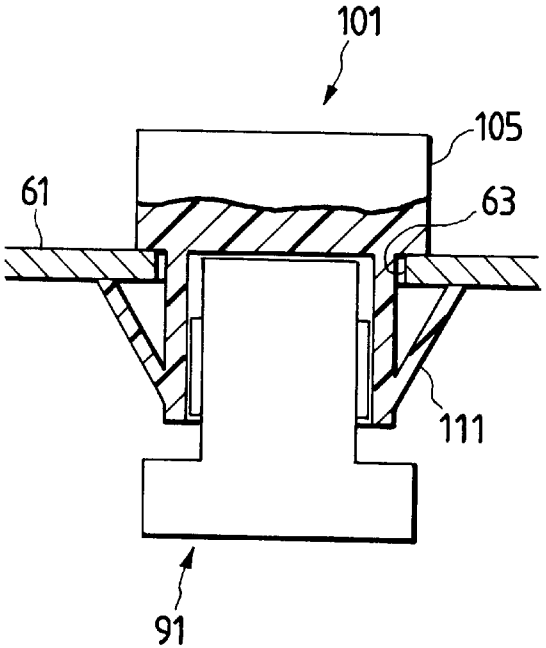

A description will subsequently be given of a second embodiment of the present invention with reference to FIGS. 3 and 4. FIG. 3 is an exploded perspective view of the second embodiment of the present invention; FIGS. 4A, 4B and 4C, diagrams illustrating a procedure for fitting connectors to each other according to the second embodiment of the present invention.

The rectangular mounting hole 63 is bored in the joint body 61. A protrusion 95 serving as a temporarily retaining mechanism is protruded from the upper and lower rear surfaces of the housing 93 of a first connector 91 as a female connector which is mounted with a female terminal, for example, and the external shape of the protrusion 95 is set greater than the size of the mounting hole 63. Further, a pair of temporarily fixing pieces 97 serving as a temporarily retaining mechanism are each provided on the upper and lower front surfaces of the housing 93 in such a manner that the base end of each temporarily fixing piece 97 is made integral with the housing 93 and that its leading end is opened toward the rear side of the housing 93. The temporarily fixing pieces 97 normally maintain a V-shaped open condition and when they are pressed from the vertical direction, they are closed in parallel to the upper and lower surfaces of the housing 93. When the leading end side of the housing 93 of the first connector 91 is inserted into the mounting hole 63, the temporarily fixing pieces 97 that have been closed while passed through the mounting hole 63 are opened again on the opposite side of the joint body 61, which is clamped between the leading ends of the temporarily fixing pieces 97 and the protrusion 95, whereby the first connector 91 is mounted in the joint body 61.

A protrusion 105 serving as a primarily retaining mechanism is protruded from the upper and lower rear surfaces of the housing 103 of a second connector 101 as a male connector which is mounted with a male terminal, for example, and the external shape of the protrusion 105 is set greater than the size of the mounting hole 63. The leading end of the housing 103 of the second connector 101 is formed into a hood portion 107 for accommodating the leading end of the first connector 91. The external shape of the hood portion 107 is set smaller than the size of the mounting hole 63. A pair of primarily fixing pieces 111 serving as a primarily retaining mechanism are each provided on the upper and lower front surfaces of the housing 103 in such a manner that the base end of each primarily fixing piece 111 is made integral with the housing 103 and that its leading end is opened toward the rear side of the housing 103. The primarily fixing pieces 111 normally maintain a V-shaped open condition and when they are pressed from the vertical direction, they are closed in parallel to the upper and lower surfaces of the housing 103.

A method of fitting connectors according to this embodiment of the present invention will subsequently be described.

When the leading end portion of the first connector 91 is inserted into the mounting hole 63 as shown in FIG. 4, the temporarily fixing pieces 97 are opened on the opposite side of the joint body 61, whereby the first connector 91 is temporarily retained in the joint body 61 since the edge portion of the mounting hole 63 is clamped between the temporarily fixing pieces 97 and the protrusion 95.

Then the second connector 101 is inserted from a side opposite to the side from which the first connector 91 has been inserted and the leading end of the first connector 91 is inserted into the hood portion 107 of the second connector 101. Since the temporarily fixing pieces 97 are kept engaging with the mounting hole 63 at this time, the first connector 91 is prevented from dropping from the mounting hole 63 but completed fitted in the second connector 101.

Simultaneously when both connectors are fitted to each other, the temporarily fixing pieces 97 of the first connector 91 are inserted into the hood portion 107 of the second connector 101 before being folded up, so that they are released from engaging with the mounting hole 63. When the second connector 101 is inserted further in this state, the first connector 91 is consequently dropped from the joint body 61.

When the second connector 101 is inserted further, the primarily fixing pieces 111 of the second connector 101 are opened after being passed through the mounting hole 63 and fixed in the joint body 61 as the edge portion of the mounting hole 63 is clamped between the primarily fixing pieces 111 and the protrusion 105. Since the first connector 91 thus dropped is kept fitting into the second connector 101, it is indirectly fixed in the joint body 61 via the second connector 101.

In this method of fitting connectors, it is facilitated to confirm the fitted condition of both connectors since the first connector 91 drops from the joint body 61 simultaneously when the first connector 91 is fitted into the second connector 101.

In this connector, moreover, the temporarily fixing pieces 97 are provided for the first connector 91, and those opened in the V-shape are retained in the joint body 61 so that the first connector 91 is fitted into the second connector 101. Therefore, the temporarily retaining strength at the time of fitting connectors can be made greater than that in the aforesaid first and second embodiments of the present invention to ensure that the second connector 101 is fitted into the first connector 91.

Third Embodiment

Figure 5:
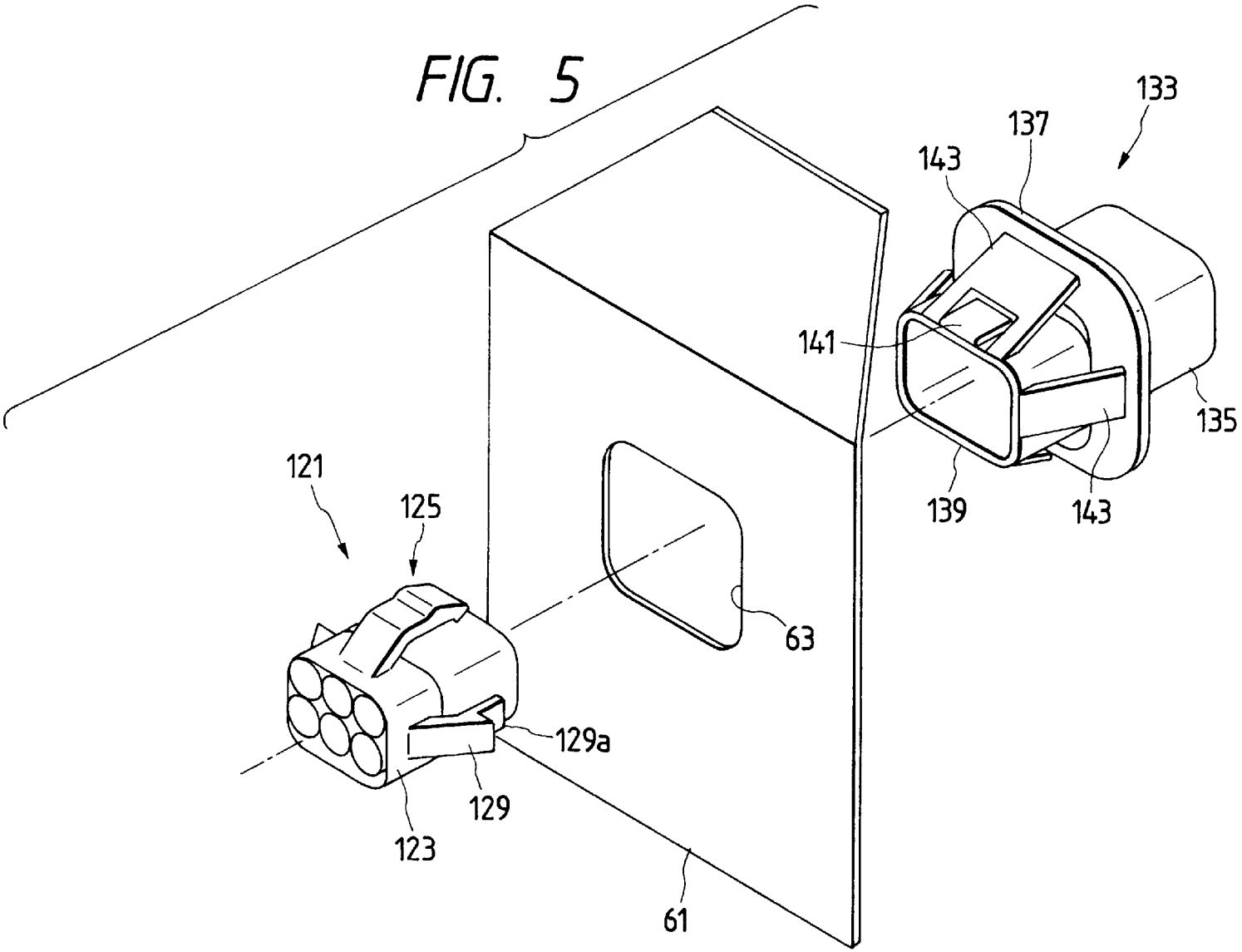
FIG. 5 is an exploded perspective view of a third embodiment of the present invention.
Figure 6A:
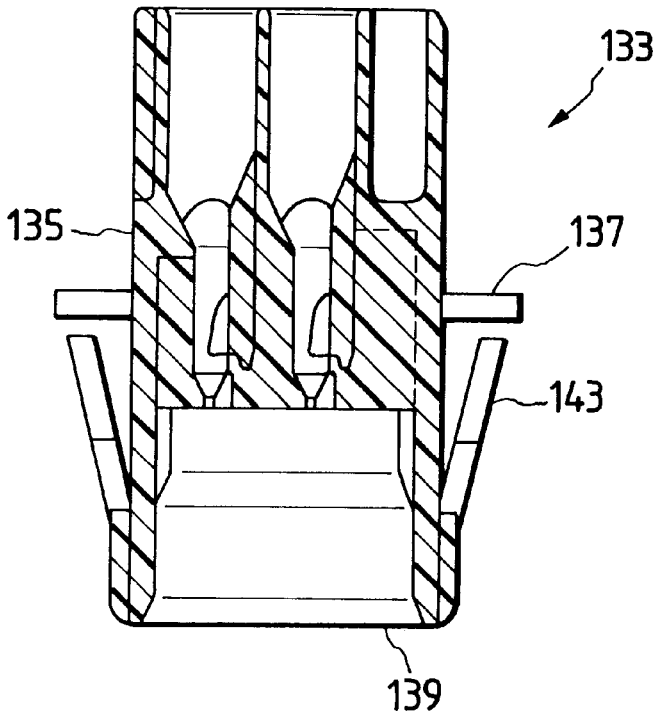
FIGS. 6A and 6B are sectional views of a second connector and a first connector, respectively.
Figure 6B:
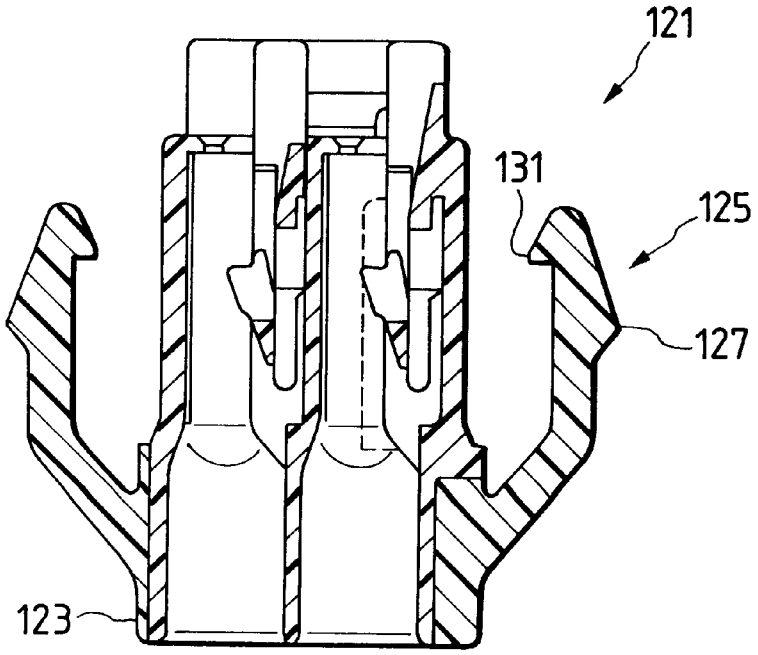
Figures 7A, 7B, 7C, 7D:
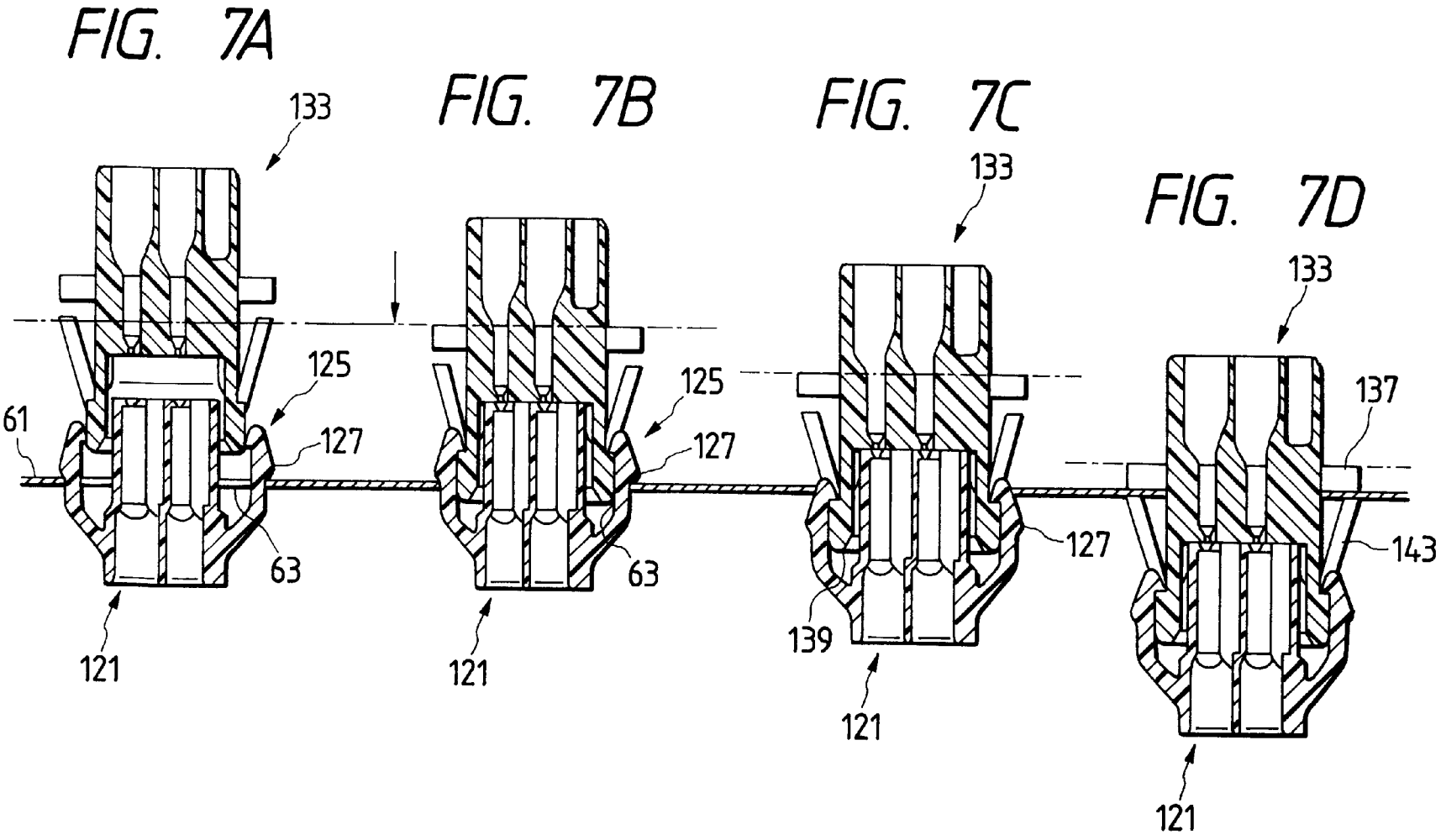
FIGS. 7A, 7B, 7C and 7D are diagrams illustrating a procedure for fitting connectors to each other according to the third embodiment of the present invention.

A description will subsequently be given of a third embodiment of the present invention with reference to FIGS. 5, 6 and 7. FIG. 5 is an exploded perspective view of a third embodiment of the present invention; FIGS. 6B and 6A, sectional views of a first connector and a second connector; and FIGS. 7A, 7B, 7C and 7D, diagrams illustrating a procedure for fitting connectors to each other according to the third embodiment of the present invention.

The rectangular mounting hole 63 is bored in the joint body 61. Elastic arms 125 serving as a temporarily retaining mechanism are each provided on the upper and lower rear surfaces of the housing 123 of a first connector 121 in such a manner that the base end of each elastic arm 125 is made integral with the housing 123 and that its leading end side as a free end is protruded toward the front of the housing 123.

A temporarily retaining mechanism (semi-locking projection) 127 projecting in the form of a chevron is provided on the outer surface of each elastic arm 125 and temporarily retained in the mounting hole 63 so that it can be inserted into and separated from the mounting hole 63. Further, auxiliary arms 129 serving as a temporarily retaining mechanism are each provided on the left and right rear side surfaces of the housing 123 in such a manner that the base end of each auxiliary arm 129 is made integral with the housing 123 and that its leading end is projected toward the front of the housing 123. A contact surface 129*a* which is brought into contact with the joint body 61 is formed on the leading end side of each auxiliary arm 129. Consequently, the semi-locking projections 127 of the elastic arms 125 are passed through the mounting hole 63 when the leading end side of the housing 123 of the first connector 121 is inserted into the mounting hole 63, whereby the first connector 121 is retained on the rear side of the mounting hole 63. When the contact surfaces 129*a* of the auxiliary arms 129 are brought into contact with the front side of the joint body 61, the joint body 61 is clamped between the semi-locking projections 127 and the auxiliary arms 129, whereby the first connector 121 is temporarily retained in the joint body 61. A projected linking lock 131 to be joined to the second connector, which will be more fully discussed hereinafter, is provided on the inner leading end side of each elastic arm 125.

A protrusion 137 serving as a primarily retaining mechanism is provided in the rear of the housing 135 of a second connector 133, and the external shape of the protrusion 137 is set greater than the size of the mounting hole 63. A hood portion 139 for accommodating the leading end of the first connector 121 is formed in the leading end of the housing 135. Linking projections 141 engaging with the projected linking locks 131 of the first connector 121 are each provided on the upper and lower surfaces of the leading end of the hood portion 139. Primarily fixing pieces 143 serving as a primarily retaining mechanism are each provided on the upper and lower surfaces and left and right side surfaces of the hood portion 139 in such a manner that the base end of each primarily fixing piece 143 is made integral with the housing 135 and that its leading end is opened toward the rear side of the housing 135. The primarily fixing pieces 143 normally maintain a V-shaped open condition and when they are pressed from the vertical direction, they are closed in parallel to the outer surface of the housing 135.

A method of fitting connectors according to this embodiment of the present invention will subsequently be described.

When the leading end side of the housing 135 of the first connector 121 is inserted into the mounting hole 63 as shown in FIG. 7, the semi-locking projections 127 of the elastic arms 125 are retained on the rear side of the mounting hole 63, and the contact surfaces 129*a* of the auxiliary arms 129 are brought into contact with the front side of the mounting hole 63, whereby the first connector 121 is temporarily retained in the joint body 61.

Subsequently, the elastic arms 125 run onto the linking projections 141 of the second connector 133 when the second connector 133 is inserted from a side opposite to the side from which the first connector 121 has been inserted and the elastic arms 125 are forced to expand. Consequently, the semi-locking projections 127 of the first connector 121 are pressed against the inner periphery of the mounting hole 63 to ensure that the first connector 121 is solidly fixed in the mounting hole 63 further.

When the second connector 133 is inserted further in that state, the leading end of the first connector 121 is accommodated in the hood portion 139 of the second connector 133, and the fitting operation is completed. The projected linking locks 131 of the elastic arms 125 run over the linking projections 141 simultaneously when the fitting operation is completed and the projected linking locks 131 engage with the linking projections 141, so that the fitted condition of the first connector 121 and the second connector 133 is locked.

When the second connector 133 is press-fitted further in the direction in which it is inserted simultaneously with the deformation of the elastic arms 125 inward, the semi-locking projections are released from the mounting hole 63, and the first connector 121 is dropped from the mounting hole 63. A feeling of clicking (feeling of moderation) is produced when the semi-locking projections 127 are released from the mounting hole 63, so that the completely fitted condition of both connectors 121, 133 becomes confirmable. When the second connector 133 is inserted further then, the primarily fixing pieces 143 of the second connector 133 are passed through the mounting hole 63 and opened on the rear side of the mounting hole 63, whereby the second connector 133 is fixed in the joint body 61 as the edge portion of the mounting hole 63 is clamped between the primarily fixing pieces 143 and the protrusion 137. Consequently, the first connector 121 dropped from the mounting hole 63 is fixed in the joint body 61 via the second connector 133 in the locked condition.

In this method of fitting connectors, since the first connector 121 is dropped from the joint body 61 simultaneously when the first connector 121 and the second connector 133 are fitted to each other, the fitted condition of both connectors 121, 133 is readily confirmable from the feeling of clicking produced then. In addition, the elastic arms 125 expand so as to press the semi-locking projections 127 against the mounting hole 63 when the second connector 133 is inserted, whereby the first connector 121 is temporarily and solidly fixed to ensure that the first connector 121 is prevented from being released before the first connector 121 is fitted in.

In this connector, moreover, since the semi-locking projections 127 are removed from the mounting hole 63 by providing the semi-locking projections 127 for the elastic arms 125 and subjecting the elastic arms 125 to elastic deformation by the inserting force of the second connector 133, a feeling of clicking can be produced when the first connector 121 and the second connector 133 are fitted to each other.

Fourth Embodiment

Figure 8:
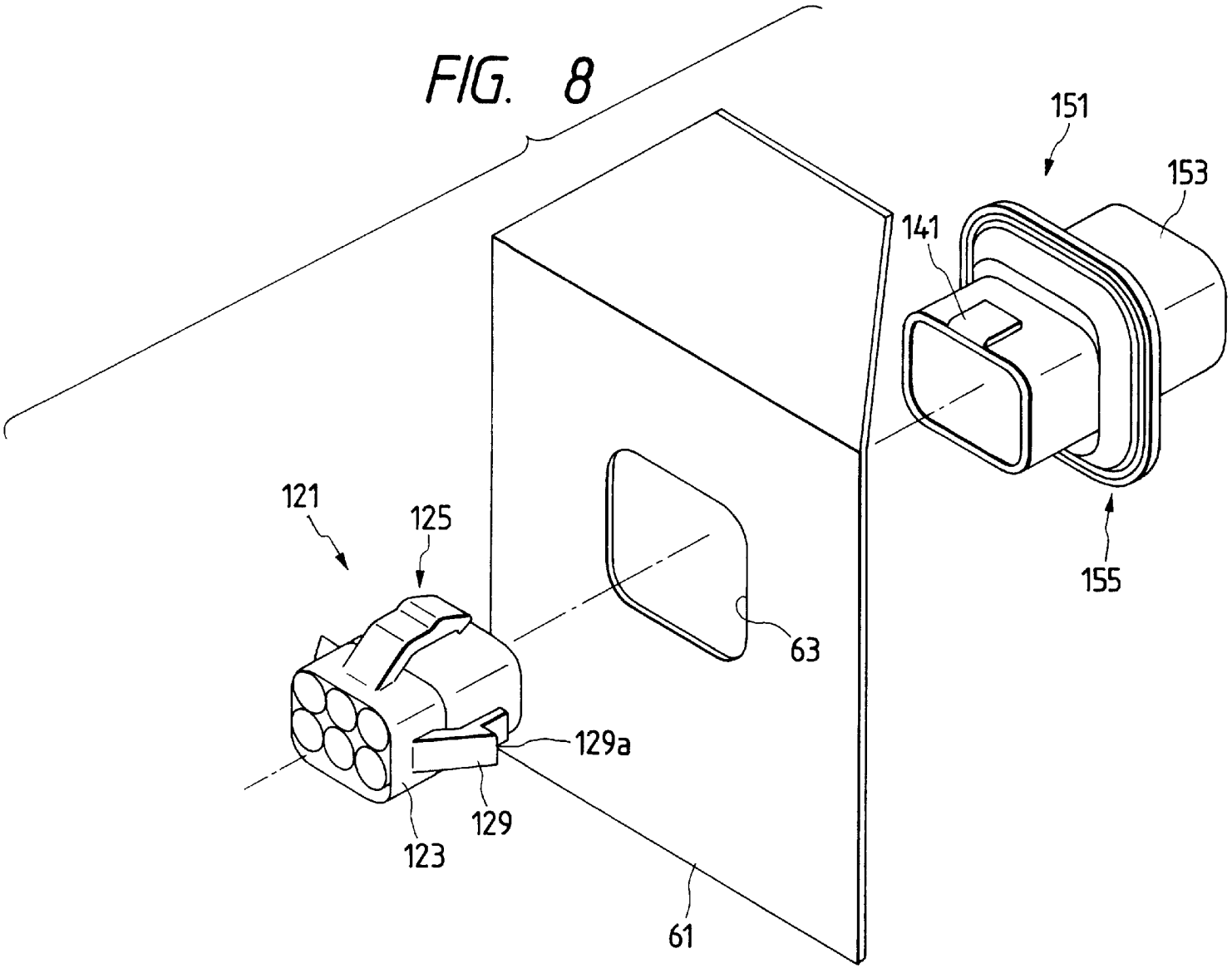
FIG. 8 is an exploded perspective view of a fourth embodiment of the present invention.
Figure 9:
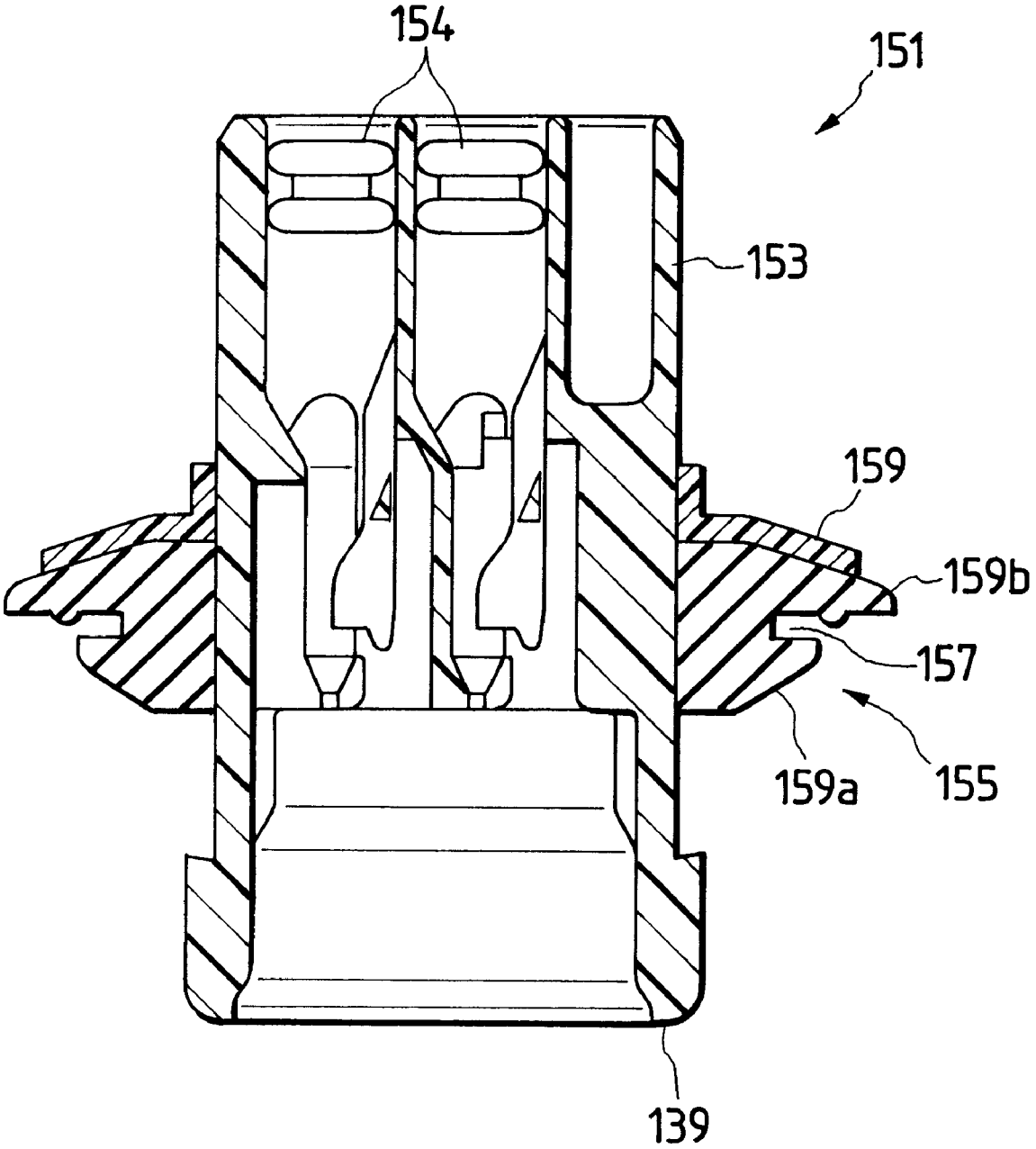
FIG. 9 is a sectional view of a second connector.
Figures 10A, 10B, 10C, 10D:
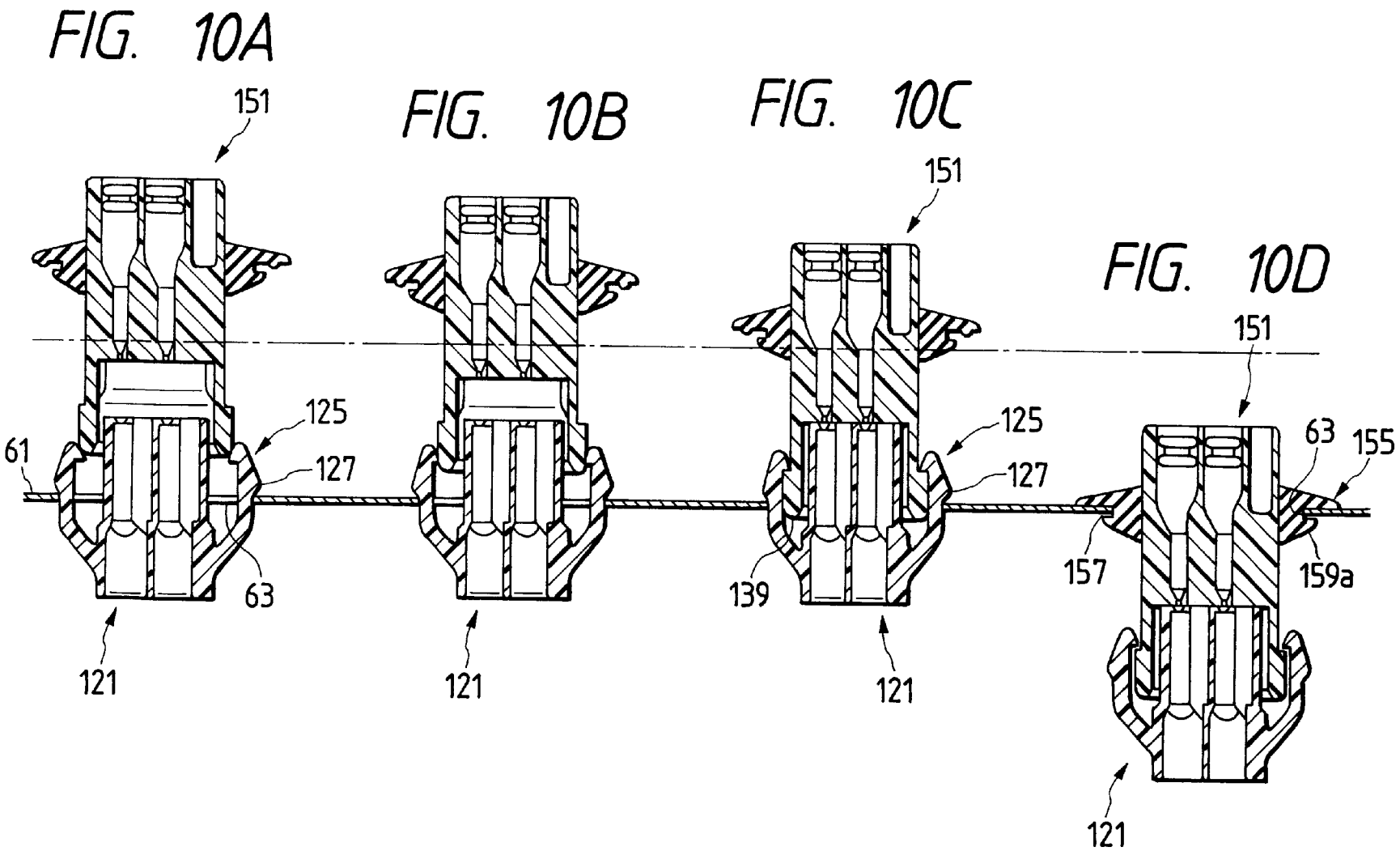
FIGS. 10A, 10B, 10C and 10D are diagrams illustrating a procedure for fitting connectors to each other according to the fourth embodiment of the present invention.

A description will subsequently be given of a fourth embodiment of the present invention with reference to FIGS. 8, 9 and 10. FIG. 8 is an exploded perspective view of a fourth embodiment of the present invention; FIG. 9, a sectional view of the second connector; and FIGS. 10A, 10B, 10C and 10D are diagrams illustrating a procedure for fitting connectors to each other according to the fourth embodiment of the present invention.

The description of the first connector 121 will be omitted as the same first connector according to the third embodiment of the present invention is employed according to this embodiment of the present invention.

In a housing 153 of a second connector 151 is a rubber stopper 154 for sealing up the gap between electric the wire and the inner housing wall in a waterproof fashion. A grommet 155 serving as a primarily retaining mechanism is fitted to the outer periphery of the housing 153 of the second connector 151, and a peripheral groove 157 is formed in the outer periphery of the grommet 155. The whole periphery of the edge portion of mounting hole 63 is fitted into the peripheral groove 157. Lip portions 159*a*, 159*b* for clamping the peripheral groove 157 therebetween are such that the external shape of the lip portion 159*a* on the leading end side of the housing 153 is set smaller than that of the lip portion 159*b* on the rear end side thereof. In other words, the grommet 155 is arranged so that the peripheral groove 157 can be fitted into the edge portion of the mounting hole 63 by press-fitting the lip portion 159*a* on the leading end side into the mounting hole 63. Moreover, a flange portion 159 having an external shape greater than the mounting hole 63 is provided on the rear surface of the lip portion 159*b* on the rear end side and used to prevent the lip portion 159*b* on the rear end side from slipping off the mounting hole 63. The hood portion 139 for accommodating the leading end of the first connector 121 is formed at the leading end of the housing 153. The linking projections 141 for engaging with the linking lock 131 of the first connector 121 are each provided on the upper and lower surfaces of the leading end of the hood portion 139.

A method of fitting connectors according to this embodiment of the present invention will subsequently be described.

When the leading end side of the housing 135 of the first connector 121 is inserted into the mounting hole 63 as shown in FIG. 10, the semi-locking projections 127 of the elastic arms 125 are retained on the rear side of the mounting hole 63, and the contact surfaces 129*a* of the auxiliary arms 129 are brought into contact with the front side of the mounting hole 63, whereby the first connector 121 is temporarily retained in the joint body 61.

Subsequently, the elastic arms 125 run onto the linking projections 141 of the second connector 151 when the second connector 151 is inserted from a side opposite to the side from which the first connector 121 has been inserted and the elastic arms 125 are forced to expand. Consequently, the semi-locking projections 127 of the first connector 121 are pressed against the inner periphery of the mounting hole 63 to ensure that the first connector 121 is solidly fixed in the mounting hole 63 further.

When the second connector 151 is inserted further in that state, the leading end of the first connector 121 is accommodated in the hood portion 139 of the second connector 151, and the fitting operation is completed. The projected linking locks 131 of the elastic arms 125 run over the linking projections 141 simultaneously when the fitting operation is completed and the projected linking locks 131 engage with the linking projections 141, so that the fitted condition of the first connector 121 and the second connector 151 is locked.

When the second connector 151 is press-fitted further in the direction in which it is inserted simultaneously with the deformation of the elastic arms 125 inward, the semi-locking projections 127 are released from the mounting hole 63, and the first connector 121 is dropped from the mounting hole 63. A feeling of clicking (feeling of moderation) is produced when the semi-locking projections 127 are released from the mounting hole 63, so that the completely fitted condition of both connectors 121, 151 becomes confirmable. When the second connector 151 is inserted further then, the lip portion 159*a* of the grommet 155 of the second connector 151 is forced into the mounting hole 63, and the edge portion of the mounting hole 63 is fitted into the peripheral groove 157 of the grommet 155, whereby the second connector 151 is fixed via the grommet 155 in the joint body 61. Consequently, the first connector 121 dropped from the mounting hole 63 is fixed in the joint body 61 via the second connector 133 in the locked condition.

In this method of fitting connectors, since the first connector 121 is dropped from the joint body 61 simultaneously when the first connector 121 and the second connector 151 are fitted to each other, the fitted condition of both connectors 121, 133 is readily confirmable from the feeling of clicking produced then. In addition, the elastic arms 125 expand so as to press the semi-locking projections 127 against the mounting hole 63 when the second connector 151 is inserted, whereby the first connector 121 is temporarily and solidly fixed to ensure that the first connector 121 is prevented from being released before the first connector 121 is fitted in. Moreover, a series of operations in the direction in which the second connector 151 is inserted results in fixing the second connector 151 in the joint body 61 in the waterproof fashion, so that the fitting work and waterproof treatment are extremely facilitated.

In this connector, moreover, since the gap between the mounting hole 63 and the connector is sealed up in the waterproof fashion by the rubber stoppers 154 provided for the second connector 151 and the grommet 155 without using the waterproof member for the first connector 121, waterproof sealing is made possible with a smaller number of parts.

Fifth Embodiment

Figure 11:
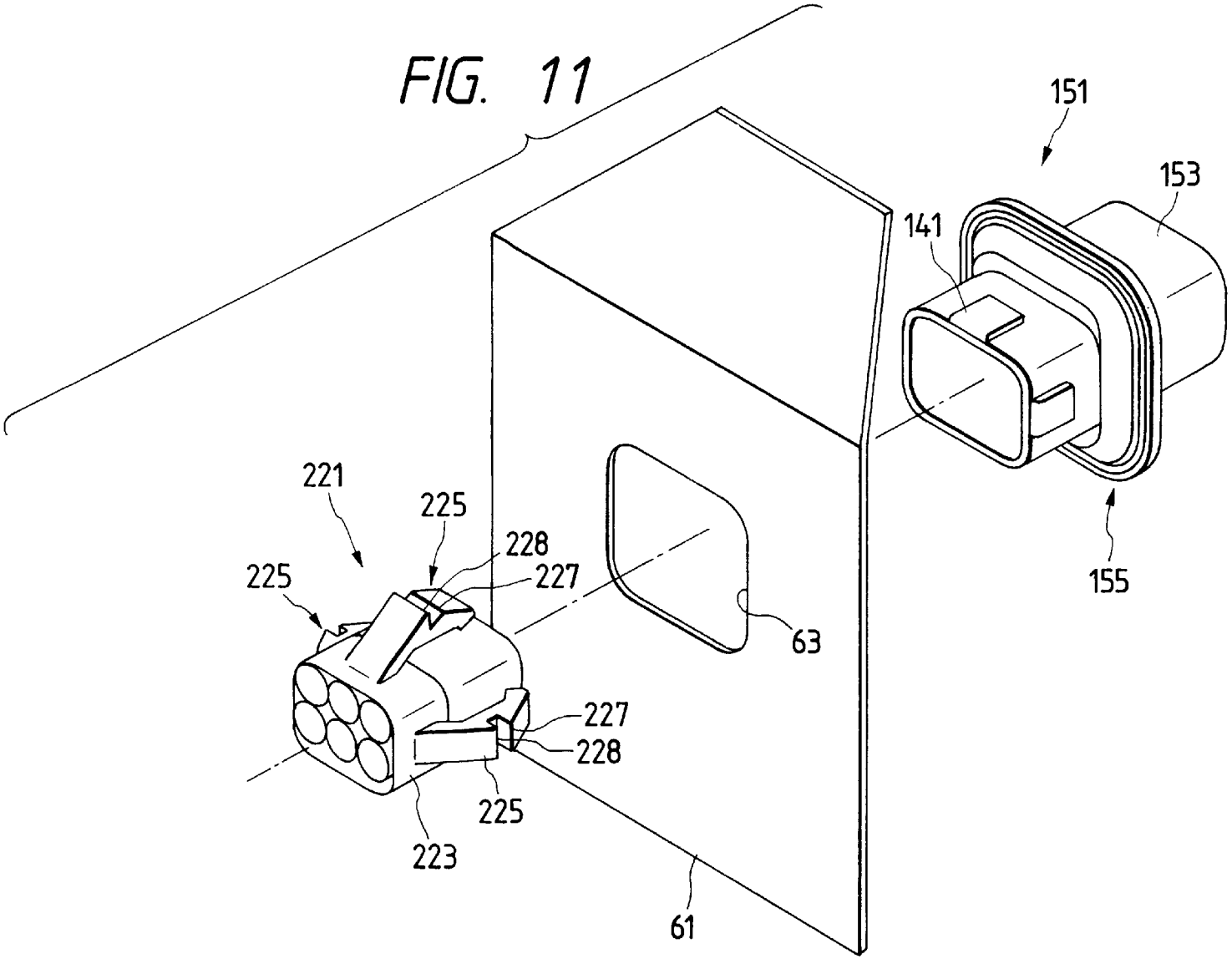
FIG. 11 is an exploded perspective view of a fifth embodiment of the present invention.

A description will subsequently given of a fifth embodiment of the present invention with reference to FIGS. 11 and 12. FIG. 11 is an exploded perspective view of a fifth embodiment of the present invention; and FIG. 12, a sectional view of the connector in a temporarily retained condition.

The same other-side connector 151 as described in the fourth embodiment of the present invention is also employed according to this embodiment thereof, whereupon the description of basic operations similar to those in the fourth embodiment thereof will be omitted as occasion demands.

As shown in FIG. 11, a temporarily retaining mechanism comprises elastic arms 225 projecting from the outer surface of a first connector 221, and a pair of semi-locking projections 227, 228 which are formed on the outer surface of each elastic arm 225 and capable of engaging with both front and rear edge sides of the mounting hole 63.

Figure 12:
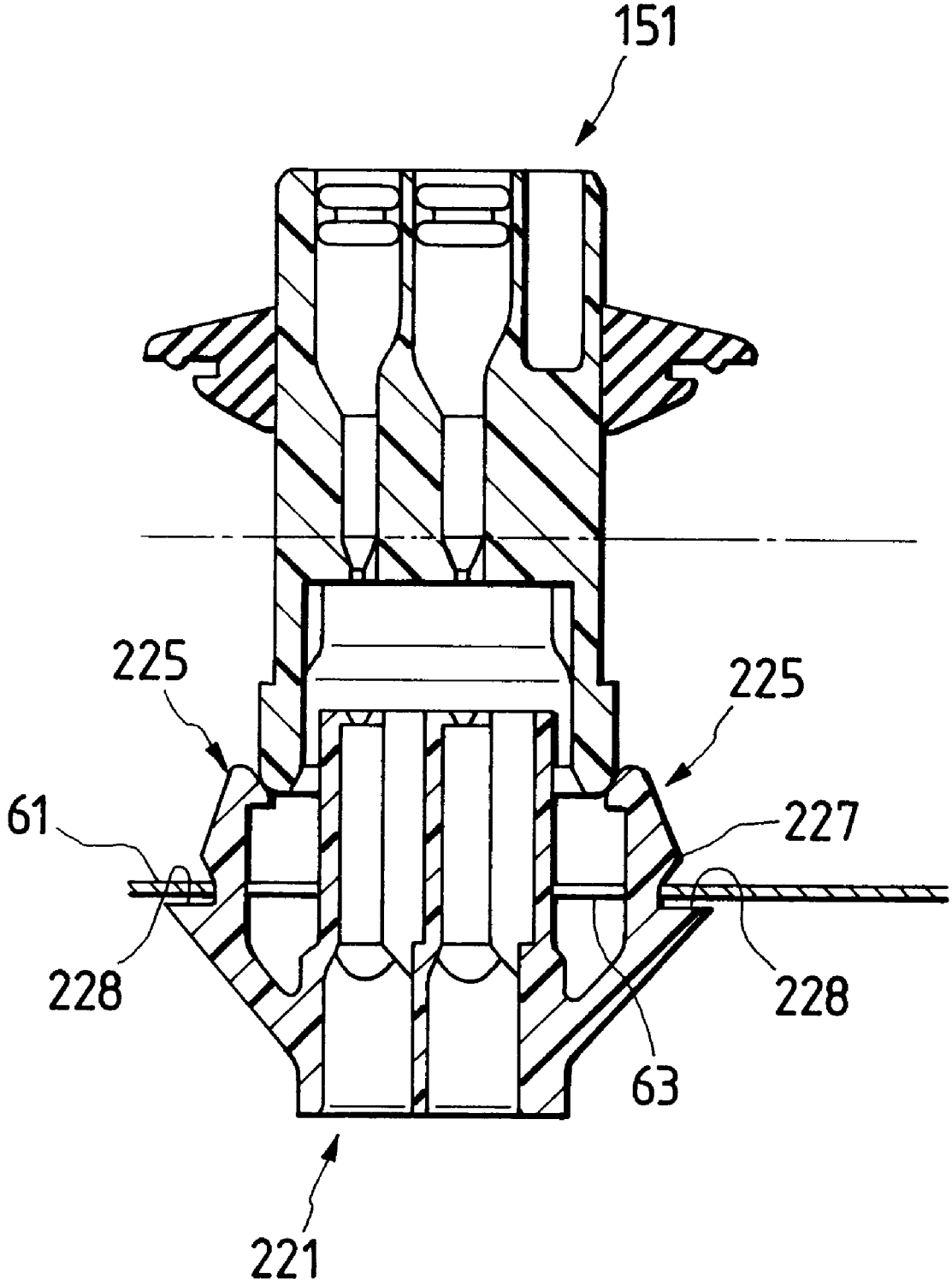
FIG. 12 is a sectional view of the connectors shown in FIG. 11.

Consequently, the temporarily retained condition is such that, as shown in FIG. 12, the joint body 61 is securely clamped in between the semi-locking projections 227, 228.

A groove corresponding to the edge portion of the mounting hole 63 is formed by the semi-locking projections 227, 228 according to this embodiment of the present invention. This groove is made long enough to ensure that the first connector 221 is retained in the direction in which it is rotated.

Further, the elastic arms 225 are provided on the whole outer surface of the first connector 221 opposite to the edge portion of the mounting hole 63 according to this embodiment of the present invention.

Since the temporarily retaining mechanism comprises the elastic arms 225 projecting from the outer surface of the first connector 221, the pair of semi-locking projections 227, 228 which are formed on the outer surface of each elastic arm 225 and capable of the front and rear edge sides of the mounting hole 63, the temporarily retained condition is extremely firmly locked.

The first connector 225 is so structured that the elastic arms 225 are provided on the whole outer surface facing the edge portion of the mounting hole 63 to ensure that the temporarily retained condition is firmly locked and that centering is achieved.

Sixth Embodiment

Figure 13:
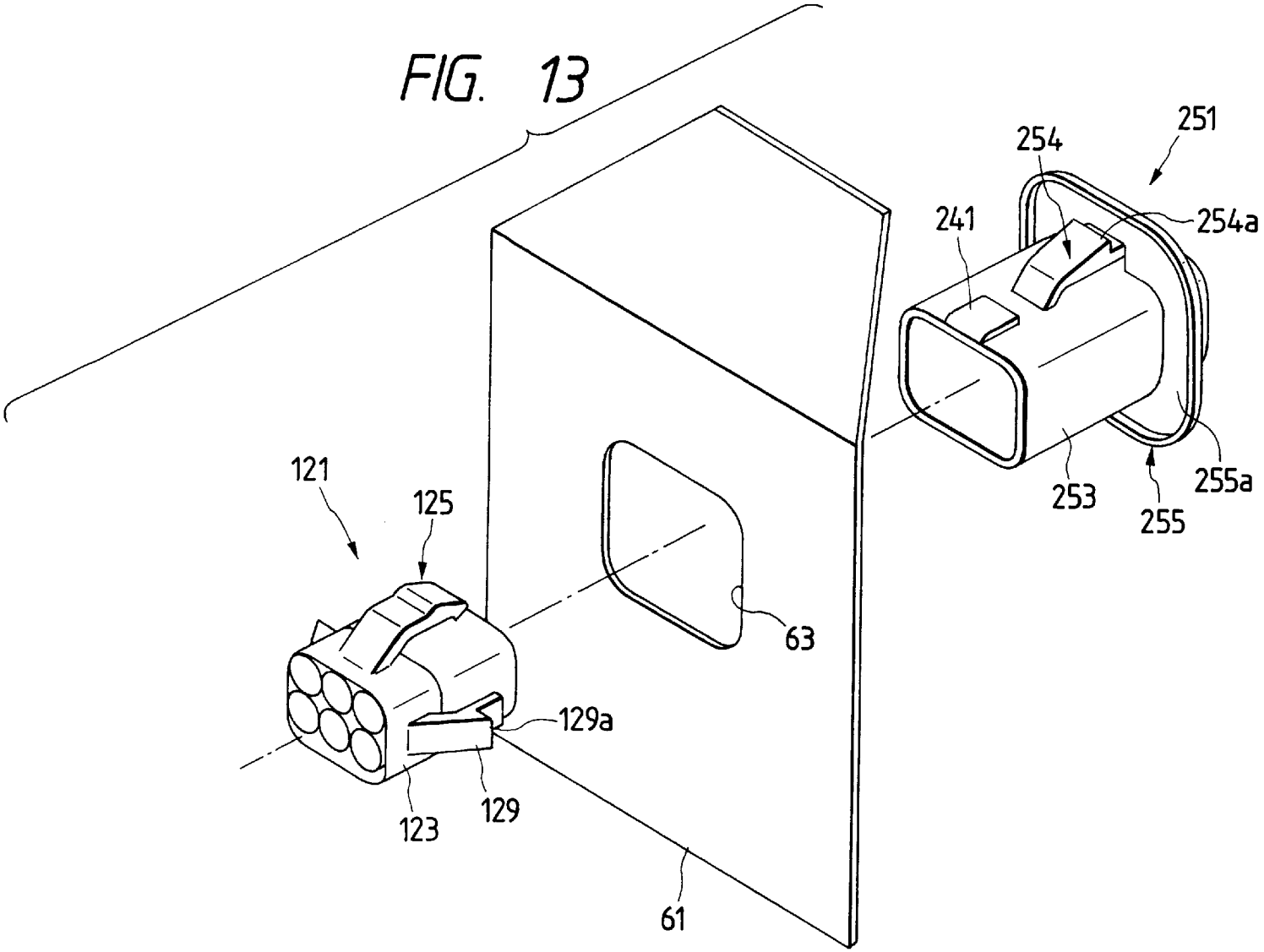
FIG. 13 is an exploded perspective view of a sixth embodiment of the present invention.
Figures 14A, 14B, 14C, 14D:
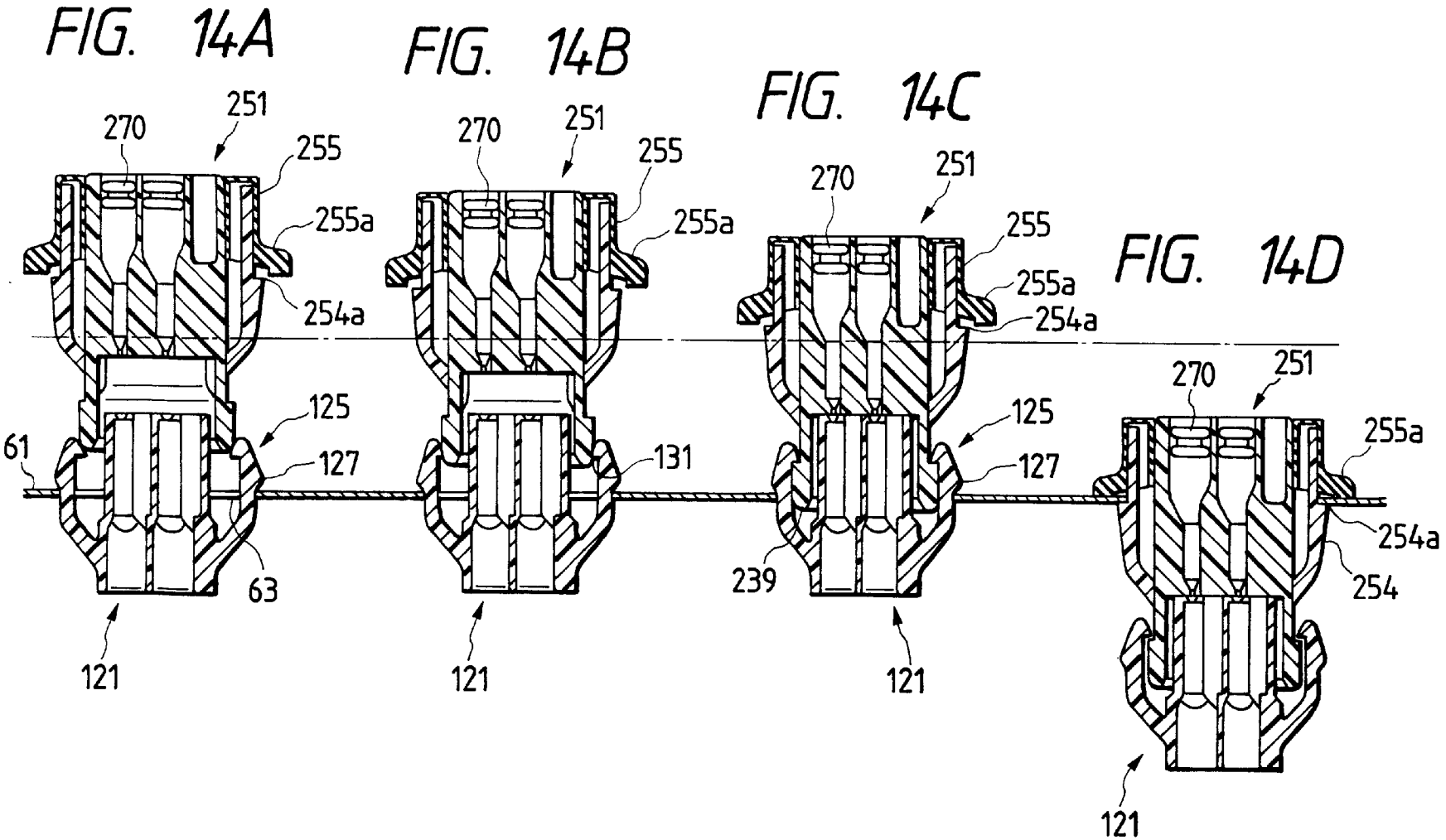
FIGS. 14A, 14B, 14C and 14D are diagrams illustrating a procedure for fitting connectors to each other according to the sixth embodiment of the present invention.

A description will subsequently given of a sixth embodiment of the present invention with reference to FIGS. 13 and 14. FIG. 13 is an exploded perspective view of a sixth embodiment of the present invention; and FIGS. 14A, 14B, 14C and 14D are diagrams illustrating a procedure for fitting connectors to each other.

The same first connector 121 as described in the fourth embodiment of the present invention is also employed according to this embodiment thereof, whereupon the description of basic operations similar to those in the fourth embodiment thereof will be omitted as occasion demands.

The primarily retaining mechanism according to this embodiment of the present invention comprises a pair of elastic retaining pieces 254 formed on the outer periphery 253 of the body of a second connector 251, the tips of the elastic retaining pieces extending in the rear direction of the second connector, the elastic retaining pieces being equipped with retaining projections 254*a* capable of engaging with one side of the edge portion of the mounting hole 63, and the grommet 255 which is fitted to the back end of the outer periphery of the body thereof and equipped with an engaging portion 255*a* capable of engaging with the other side of the edge portion of the mounting hole 63, the retaining projections 254*a* and the engaging portion 255*a* being used for clamping the edge portion of the mounting hole.

A method of fitting connectors according to this embodiment of the present invention will subsequently be described.

When the leading end side of the housing of the first connector 121 is inserted into the mounting hole 63 as shown in FIGS. 14 and 13, the semi-locking projections 127 of the elastic arms 125 are retained on the rear side of the mounting hole 63, and the contact surfaces 129*a* of the auxiliary arms 129 are brought into contact with the front side of the mounting hole 63, whereby the first connector 121 is temporarily retained in the joint body 61.

Subsequently, the elastic arms 125 run onto the linking projections 241 of the second connector 251 when the second connector 251 is inserted from a side opposite to the side from which the first connector 121 has been inserted and the elastic arms 125 are forced to expand. Consequently, the semi-locking projections 127 of the first connector 121 are pressed against the inner periphery of the mounting hole 63 to ensure that the first connector 121 is solidly fixed in the mounting hole 63 further.

When the second connector 251 is inserted further in that state, the leading end of the first connector 121 is accommodated in the hood portion 239 of the second connector 251, and the fitting operation is completed. The projected linking locks 131 of the elastic arms 125 run over the linking projections 141 simultaneously when the fitting operation is completed and the projected linking locks 131 engage with the linking projections 241, so that the fitted condition of the first connector 121 and the second connector 251 is locked.

When the second connector 251 is press-fitted further in the direction in which it is inserted simultaneously with the deformation of the elastic arms 125 inward, the semi-locking projections 127 are released from the mounting hole 63, and the first connector 121 is dropped from the mounting hole 63. A feeling of clicking (feeling of moderation) is produced when the semi-locking projections 127 are released from the mounting hole 63, so that the completely fitted condition of both connectors 121, 151 becomes confirmable. When the second connector 251 is inserted further then, the elastic retaining pieces of the second connector 251 are bent inward and the retaining projections 254*a* run over the mounting hole 63. Consequently, the engaging portion 255*a* (lip portion) of the grommet 255 is forced into the mounting hole 63, so that the second connector 251 is fixed in the joint body 61 via the grommet 255 and the elastic retaining pieces 254.

Therefore, the first connector 221 dropped from the mounting hole 63 becomes fixed in the joint body 61 via the second connector thus fitted in and locked.

In this connector, moreover, since the gap between the mounting hole 63 and the connector is sealed up in the waterproof fashion by the grommet 155 without using the waterproof member for the first connector 121, waterproof sealing is made possible with a smaller number of parts. In this case, rubber stoppers 270 are mounted in the second connector 251 and used for waterproof sealing the gap between the electric wire and the inner housing wall.

The grommet 255 and the rubber stoppers 270 disposed around the electric wire may be integrally molded. An integrally molded structure like this distributes to decreasing the number of parts and increasing the waterproof function.

Figure 15:
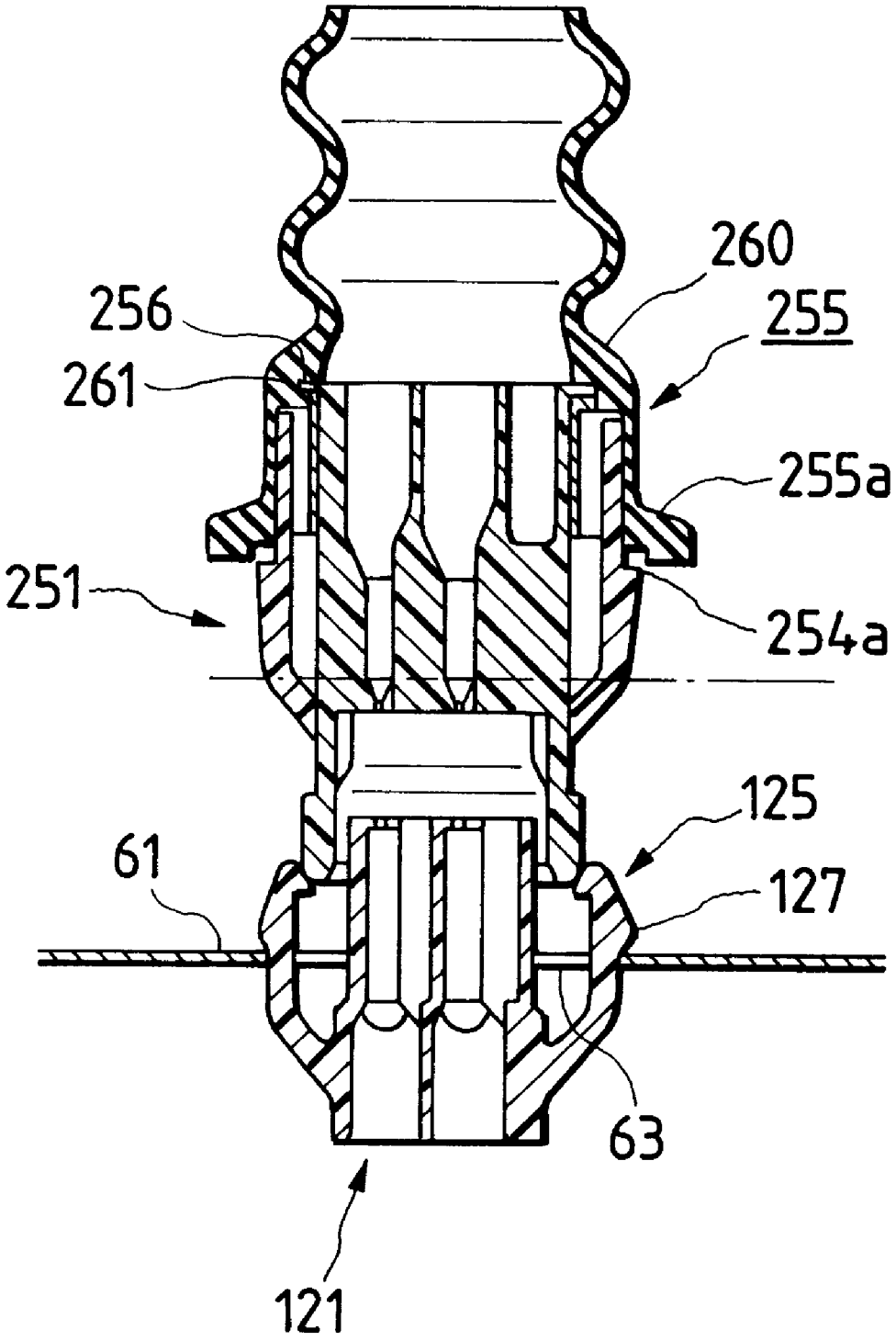
FIG. 15 is a sectional view of modified connectors according to the sixth embodiment of the present invention.

The arrangement of the grommet 255 may be altered as shown in FIG. 15.

The arrangement shown in FIG. 15 features the locking structure in which the second connector 251 and the grommet 255 are kept hardly separable. In other words, a collar-like retaining projection 256 extending in the diametrical direction of the second connector 251 is provided at the leading end of the connector, whereas a retaining recessed portion 261 is provided for the grommet 255, whereby the retaining projection 256 and the retaining recessed portion 261 are fitted to each other.

As the second connector 251 is thus firmly fixed in the grommet 255, it is possible to not only improve the adhesion of the connector 251 to the grommet 255 but set stronger the pressure applied by the grommet 255 to bringing the engaging portion 255*a* into contact with the joint body 61. Consequently, the fixed structure of the grommet like this results in making feasible the provision of an excellent solid waterproof structure.

As the grommet 255 is firmly fixed in structure as described above, moreover, it is also possible to avoid the dropping of the grommet 255 or lowering of the waterproof function thereof even though unexpected force acts on the electric wire by providing a relatively long bellows portion 260 as shown in FIG. 15.

Seventh Embodiment

Figure 16:
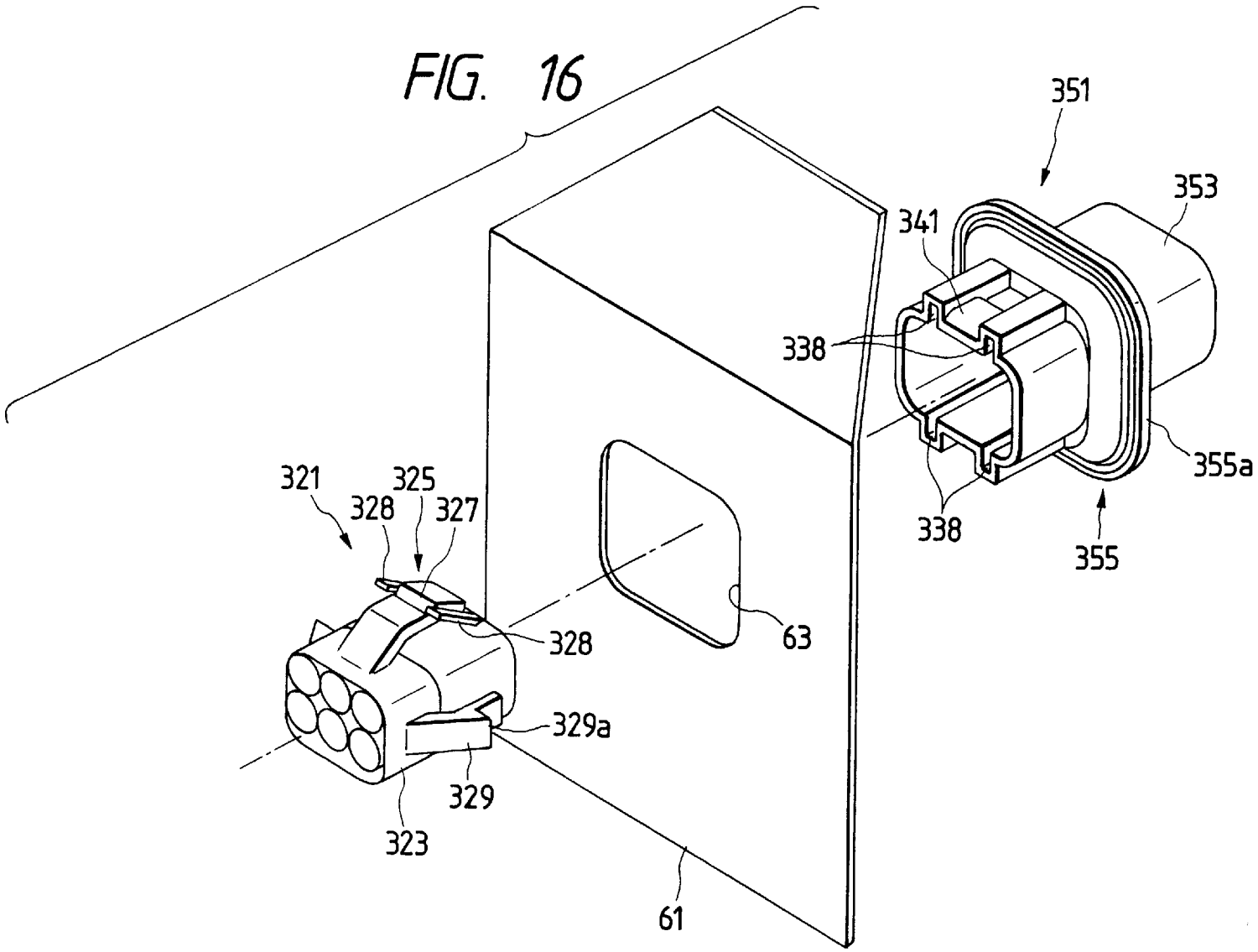
FIG. 16 is an exploded perspective view of a seventh embodiment of the present invention.
Figures 17A, 17B, 17C:
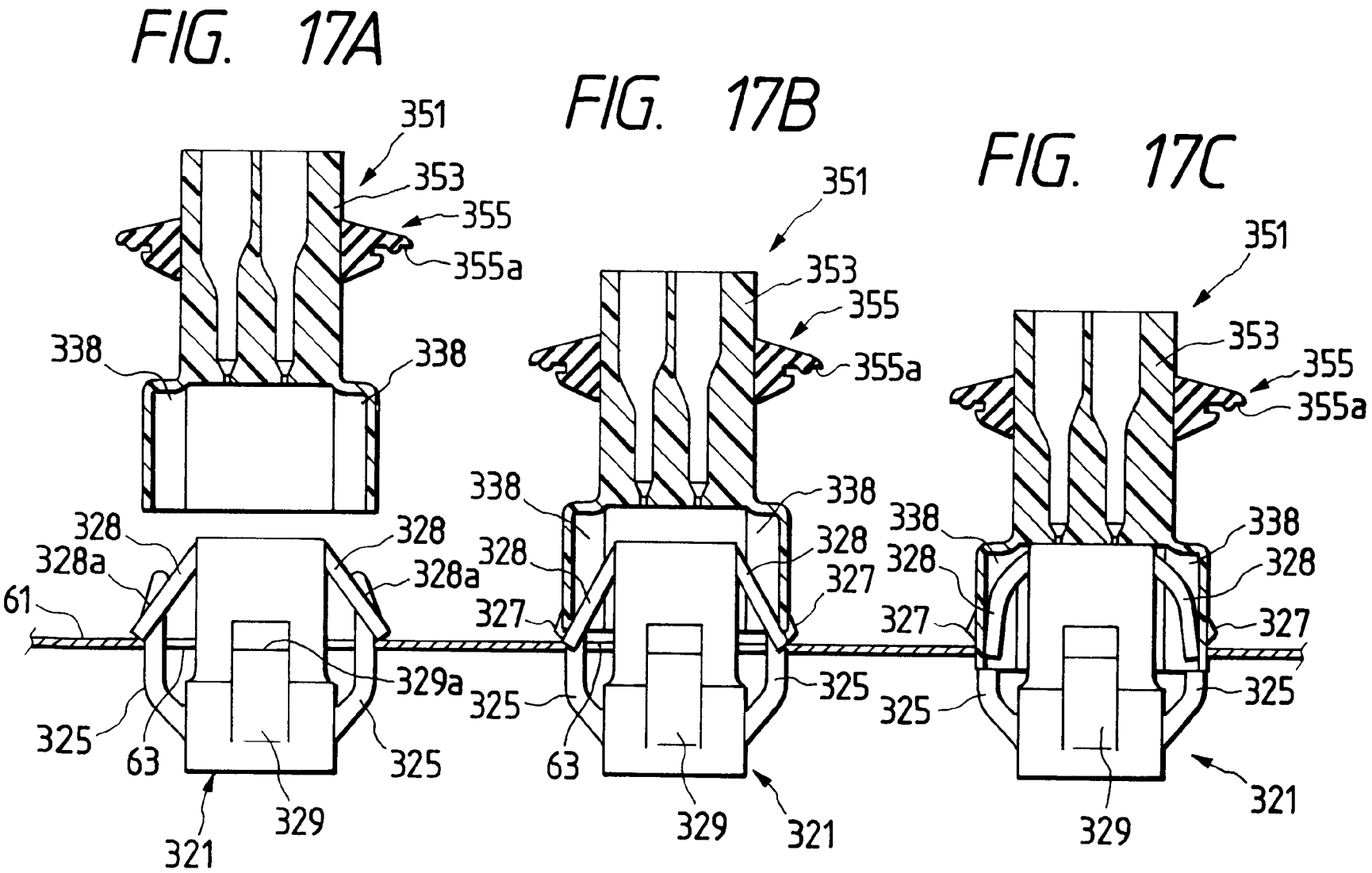
FIGS. 17A, 17B and 17C are schematic diagrams illustrating a procedure for fitting connectors to each other according to the seventh embodiment of the present invention.
Figure 18:
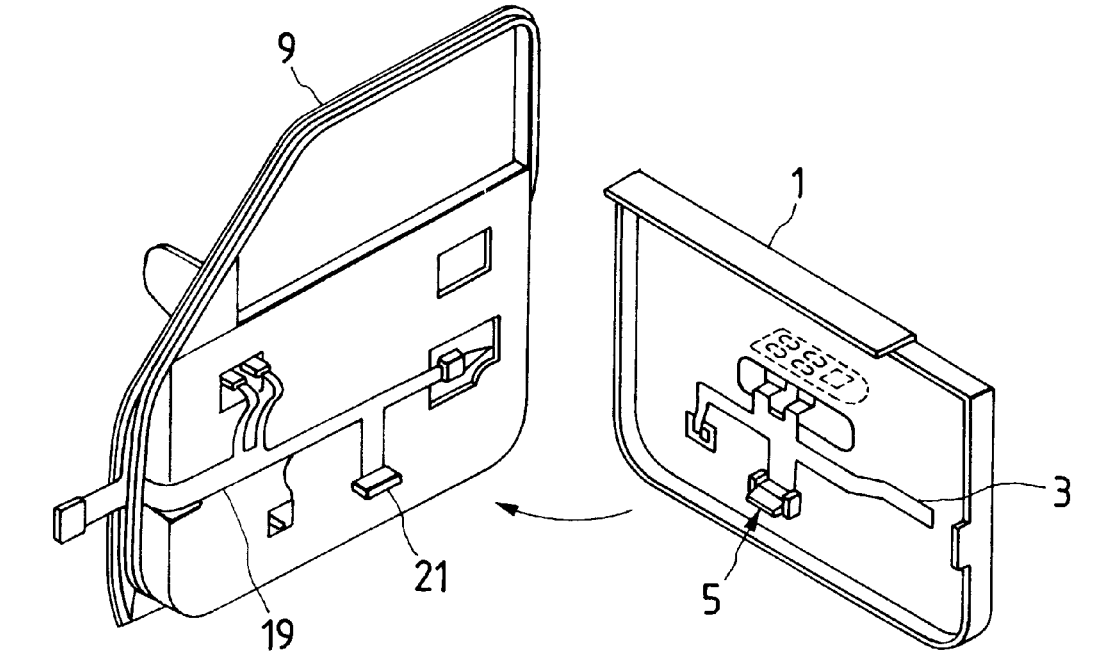
FIG. 18 PRIOR ART
FIG. 18 is an exploded perspective view illustrative of a conventional wiring method.
Figure 19:
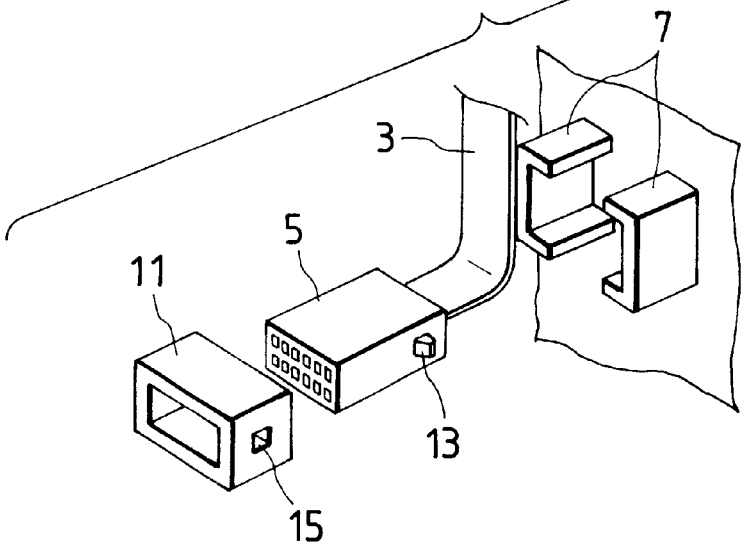
FIG. 19 PRIOR ART
FIG. 19 is an exploded perspective view of a conventional connector supporting structure on a trim side.
Figure 20:
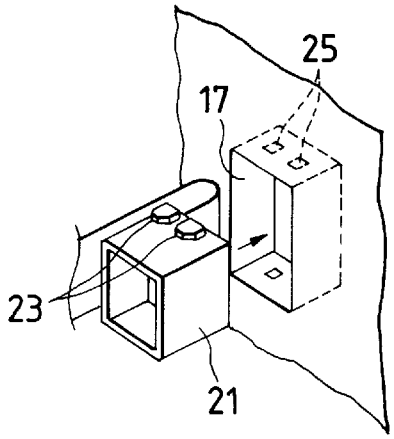
FIG. 20 PRIOR ART
FIG. 20 is an exploded perspective view of the conventional connector supporting structure on a frame side.
Figure 21:
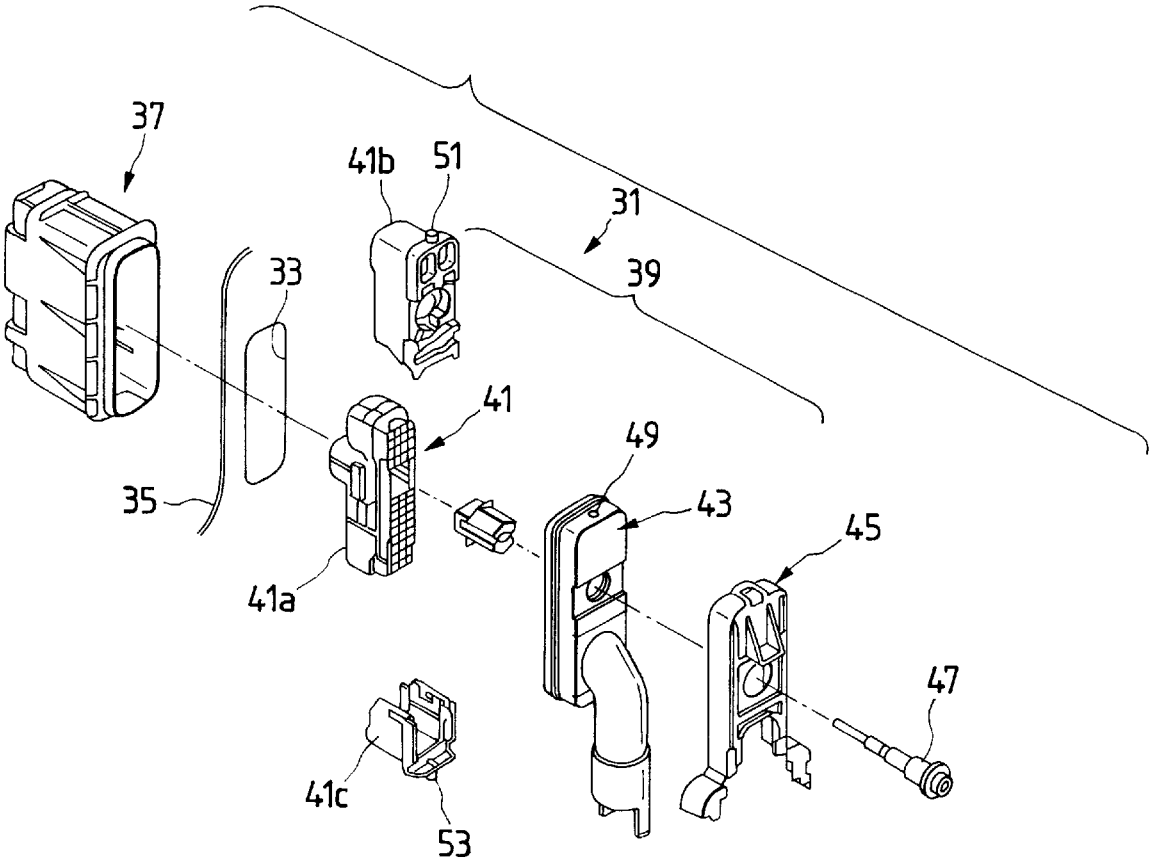
FIG. 21 PRIOR ART
FIG. 21 is an exploded perspective view of a conventional waterproof connector.

A description will subsequently given of a seventh embodiment of the present invention with reference to FIGS. 16 and 17. FIG. 16 is an exploded perspective view of a seventh embodiment of the present invention; FIGS. 17A, 17B and 17C, schematic diagrams illustrating a procedure for fitting connectors to each other according to the seventh embodiment of the present invention. Incidentally, FIG. 17 is a partial sectional view of the second connector with a joint body.

The basically same arrangement as described in the fourth embodiment of the present invention is also employed according to the seventh embodiment thereof shown in FIG. 8, whereupon the description of basic operations similar to those in the fourth embodiment thereof will be omitted as occasion demands.

A connector according to this embodiment of the present invention features a temporarily retaining mechanism which is equipped with flexible elastic arms 325 projecting from the outer surface of a first connector 321, and a semi-locking projection 327 which is formed on the outer surface of each elastic arm 325 and retained in the mounting hole 63.

Further, each elastic arm 325 is equipped with a wing 328 which is coupled to the side of the elastic arm 325 and has an inducing tilted surface 328*a* extending toward the leading end of the elastic arm further than the leading end of the elastic arm.

On the other hand, four wing-accommodating portions 338 for accommodating the wings 328 by bending them respectively are provided for a second connector 351.

A method of fitting connectors according to the seventh embodiment of the present invention will subsequently be described.

When the leading end side of the housing of the first connector 321 is inserted into the mounting hole 63 as shown in FIGS. 16 and 17, the semi-locking projections 327 of the elastic arms 325 and the upper ends of the wings 328, which will be described in detail, are retained on the rear side of the mounting hole 63, and the contact surfaces 329*a* of auxiliary arms 329 are brought into contact with the front side of the mounting hole 63, whereby the first connector 321 is temporarily retained in the joint body 61 (the state shown in FIG. 17A).

As FIG. 17 is taken from the direction in which the elastic arms 325 and the wings 328 are shown, it does not show the state in which the contact surfaces 329*a* are kept in contact with the joint body 61.

Subsequently, the elastic arms 325 run onto the linking projections 341 of the second connector 351 when the second connector 351 is inserted from a side opposite to the side from which the first connector 321 has been inserted and the elastic arms 325 are forced to expand slightly.

When the fitting of the first connector 321 and the second connector 351 is started according to this embodiment of the present invention, moreover, the tilted surfaces 328*a* of the wings 328 are brought into contact with the inner wall of the wing-accommodating portions 338 of the second connector 351 (the state shown in FIG. 17B). When the wings 328 are forced in further, they are press-fitted into the respective wing-accommodating portions 338 while being bent and accommodated in the wing-accommodating portions 338. The wings 328 cause the second connector 351 to demonstrate its guide function during the inserting operation, thus resulting in avoiding the diagonal insertion to ensure that both members are fitted to each other for the retaining purpose.

The temporarily retained and locked condition is released when the wings 328 are bent. Since the elastic arms 325 can be bent inward (in the direction in which the edge portion of the mounting hole 63 is separated) in a manner interlocking with the bending of the wings 328, it is also possible to move the semi-locking projections 327 of the elastic arms 325 of the first connector 321 slightly from the temporarily retained state to the releasing direction with respect to the mounting hole 63.

When the second connector 351 is inserted further, the leading end of the first connector is accommodated in the hood of the second connector 351 as in the fourth embodiment of the present invention and both connectors are completely fitted to each other and locked in this state.

Press-fitting the second connector 351 further in the direction in which the connector is inserted causes the semi-locking projections 327 to be released from the mounting hole 63 and makes the first connector 321 drop from the mounting hole 63. Consequently, the engaging portions 355*a* (lip portions) of a grommet is forced into the mounting hole 63, and the second connector 351 is fixed in the joint body 61.

As set forth above in detail, in the method of fitting connectors according to the present invention, the first connector drops from the joint body simultaneously when the first connector and the second connector are fitted to each other and the fitted condition of both connectors can readily be confirmed.

Moreover, the feeling of clicking produced then makes it surer to confirm the fitted condition of both connectors. In addition, the first connector can surely be prevented from being separated before the first connector is fitted in by expanding the elastic arms and pressing the semi-locking projections into the mounting hole when the second connector is inserted.

When the grommet is mounted on the outer periphery of the second connector, further, a series of operations in the direction in which the second connector is inserted results in fixing the second connector in the joint body via the grommet in a waterproof fashion, so that the fitting work and waterproof treatment are facilitated to a greater extent.

In the connector according to the present invention, the first connector is temporarily retained by the temporarily retaining mechanism which is made releasable by the inserting force of the second connector, whereas the second connector is provided with the primarily retaining mechanism, whereby after the second connector is completely fitted into the first connector in the temporarily retained condition, the second connector is the temporarily retained condition of the first connector can be primarily retained in the joint body by releasing the first connector from being temporarily retained.

Then the first connector is provided with the engaging hole and the second connector is provided with the connector fixing hole and further the connector fixing arms engaging with both holes are provided for the mounting hole; thus, the first connector in the temporarily retained condition is held by the joint body; the first connector is dropped in the fitted condition; further, the second connector is fixed in the joint body.

Further, the temporarily retained strength is increased when both connectors are fitted to each other by providing a structure in which the temporarily fixing pieces are provided for the first connector and the temporarily fixing pieces expanded in an inverted V shape is retained in the joint body.

Further, the semi-locking projections are provided for the elastic arms and removed from the mounting hole by subjecting the elastic arms to elastic deformation by the inserting force of the second connector, so that a feeling of clicking is produced when the first connector and the second connector are fitted to each other.

Further, the grommet provided on the outer periphery of the body of the second connector is used as the primarily retaining mechanism for fixing the second connector in the joint body so as to seal up the gap between the mounting hole and the connector in a waterproof fashion without using a waterproof member for the first connector and consequently the waterproofness is achievable with a smaller number of parts.

In the connector according to the present invention, when the temporarily retaining mechanism comprises the elastic arms protruding from the outer surface of the first connector, and the pair of semi-locking projections capable of respectively engaging with the front and rear edge sides of the mounting hole formed in the outer surfaces of the elastic arms, it is ensured that the temporarily retained condition is firmly locked and when it is provided with the elastic arms on the whole outer surface facing the edge portion of the mounting hole, the temporarily retained condition is firmly locked and centering is surely attainable.

In the connector according to the present invention, the primarily retaining mechanism comprises at least the pair of elastic retaining pieces formed on the outer periphery of the body of the second connector, the tips of the elastic retaining pieces extending in the rear direction of the second connector, the elastic retaining pieces being equipped with the retaining projections capable of engaging with one side of the edge portion of the mounting hole, and the grommet which is fitted to the rear end of the outer periphery of the body thereof and equipped with the engaging portion capable of engaging with the other side of the edge portion of the mounting hole, the retaining projections and the engaging portion being used for clamping the edge portion of the mounting hole, whereby the gap between the mounting hole and the connector is sealed up in the waterproof fashion without using the waterproof member for the first connector and moreover the primarily retaining mechanism becomes easily releasable without bending the elastic retaining pieces.

In the connector according to the present invention, the temporarily retaining mechanism comprises the flexible elastic arms protruding from the outer surface of the first connector, and a wing which is coupled to the side surface of each elastic arm, extended to make the first connector retainable in the mounting hole and has an inducing tilted surface extending toward the leading end of each elastic arm further than the leading end of the elastic arm. In this case, the second connector is equipped with a wing accommodating portion for accommodating the wing by bending each wing and with this arrangement, since each wing demonstrates the function of guiding the operation of inserting the second connector when the second connector is inserted, the insertion of the second connector in an inclined direction is preventable to ensure that both members are fitted and retained to each other. Therefore, the connector fitting operability is improved and any fitting miss becomes avoidable.

What is claimed is:

1. A connector, comprising:

a first connector;

a joint body including a mounting hole into which the first connector is insertable;

a temporarily retaining mechanism with which the first connector is temporarily retained in the mounting hole when the first connector is inserted into the mounting hole;

a second connector fittable into the first connector, and adaptable to release the first connector from being temporarily retained in the mounting hole by an inserting force deriving from fitting of the first and second connectors when the second connector is fitted into the first connector; and a primarily retaining mechanism with which the second connector is primarily retained in the mounting hole.

2. The connector of claim 1, wherein, the temporarily retaining mechanism comprises:

a connector fixing arm projecting toward a center of the mounting hole, the connector fixing arm being formed in an edge portion of the mounting hole; and an engaging hole formed in the first connector, the engaging hole being releasably engaged with the connector fixing arm;

the primarily retaining mechanism comprises:

a connector fixing hole formed in the second connector, the connector fixing hole being engaged with the connector fixing arm.

3. The connector of claim 1, wherein, the temporarily retaining mechanism comprises:

a first protrusion protruding from an outer surface of the first connector; and a temporarily fixing piece provided on the outer surface of the first connector, the temporarily fixing piece having a flexibility and clamping an edge portion of the mounting hole in cooperation with the first protrusion;

the primarily retaining mechanism comprises:

a second protrusion protruding from an outer surface of the second connector; and a primarily fixing piece provided on the outer surface of the second connector, the primarily fixing piece having a flexibility and clamping the edge portion of the mounting hole in cooperation with the second protrusion.

4. The connector of claim 1, wherein, the primarily retaining mechanism comprises:

at least a pair of elastic retaining pieces formed on an outer periphery of a body of the second connector, tips of the elastic retaining pieces extending in a rear direction of the second connector, the elastic retaining pieces being equipped with retaining projections capable of engaging with one side of an edge portion of the mounting hole; and a grommet fitted to a back end of the outer periphery of the body, the grommet being equipped with an engaging portion capable of engaging with the other side of the edge portion of the mounting hole, wherein the retaining projections and the engaging portion clamp the edge portion of the mounting hole.

5. The connector of claim 1, wherein, the temporarily retaining mechanism comprises:

elastic arms protruding from an outer surface of the first connector, and having a flexibility; and wings coupled to side surfaces of the elastic arms, the wings being extended to make the first connector retainable in the mounting hole, and the wings having inducing tilted surfaces which extend toward positions further than leading ends of the elastic arms, the second connector includes a wing accommodating portion into which the wings are insertable while being bent, wherein the wings are inserted into the wing accommodating portion while being bent before the first connector and the second connector are completely fitted to each other.

6. The connector of claim 1, wherein, the temporarily retaining mechanism comprises:

an elastic arm protruding from an outer surface of the first connector;

a semi-locking projection formed on an outer surface of the elastic arm; and an auxiliary arm protruding from the outer surface of the first connector, the auxiliary arm having flexibility and clamping an edge portion of the mounting hole in cooperation with the semi-locking projection;

the primarily retaining mechanism comprises:

a protrusion protruding from an outer surface of the second connector; and a primarily fixing piece provided on the outer surface of the second connector, the primarily fixing piece having a flexibility and clamping the edge portion of the mounting hole in cooperation with the protrusion.

7. The connector of claim 6, wherein the primarily retaining mechanism includes a grommet fitted on an outer periphery of the second connector, the grommet having a peripheral groove formed in an outer periphery thereof, the peripheral groove engaged with the mounting hole.

8. The connector of claim 1, wherein the temporarily retaining mechanism comprises:

elastic arms protruding from an outer surface of the first connector; and a pair of semi-locking projections capable of respectively engaging with front and rear edge sides of the mounting hole, the semi-locking projections being respectively formed in outer surfaces of the elastic arms.

9. The connector of claim 8, wherein the elastic arms are provided on the respective outer surfaces of the first connector facing edge portions of the mounting hole.

* * * * *